US010479672B2

(12) United States Patent
Nini

(10) Patent No.: US 10,479,672 B2
(45) Date of Patent: Nov. 19, 2019

(54) DELIVERING DEVICE OF LIQUIDS FROM WATER CROCKS EQUIPPED WITH A SYSTEM OR KIT FOR REPLACING WATER CROCKS WITH VESSELS OF THE "BAG-IN-BOX" TYPE FOR THEIR DELIVERY

(71) Applicant: VITOP MOULDING S.R.L., Alessandria (IT)

(72) Inventor: Diego Nini, Alessandria (IT)

(73) Assignee: VITOP MOULDING S.R.L., Alessandria (IT)

( * ) Notice: Subject to any disclaimer, the term of this patent is extended or adjusted under 35 U.S.C. 154(b) by 29 days.

(21) Appl. No.: 15/524,459

(22) PCT Filed: Nov. 7, 2014

(86) PCT No.: PCT/IT2014/000298
§ 371 (c)(1),
(2) Date: May 4, 2017

(87) PCT Pub. No.: WO2016/071933
PCT Pub. Date: May 12, 2016

(65) Prior Publication Data
US 2018/0273371 A1 Sep. 27, 2018

(51) Int. Cl.
*B67D 3/00* (2006.01)

(52) U.S. Cl.
CPC ..... *B67D 3/0083* (2013.01); *B67D 3/0029* (2013.01); *B67D 3/0038* (2013.01)

(58) Field of Classification Search
CPC ... B67D 3/0083; B67D 3/0029; B67D 3/0038
See application file for complete search history.

(56) References Cited

U.S. PATENT DOCUMENTS 3,848,776 A * 11/1974 Schieser ..... B65D 85/54 222/105
4,515,294 A * 5/1985 Udall ..... B65D 77/065 222/105
4,573,612 A * 3/1986 Maddison ..... A47K 5/1209 222/105

(Continued)

*Primary Examiner* — David P Angwin
*Assistant Examiner* — Bob Zadeh
(74) *Attorney, Agent, or Firm* — Amster, Rothstein & Ebenstein LLP

(57) ABSTRACT

A delivering device (12) of liquids contained in water crocks is described, equipped with a system or kit (1) for replacing the water crocks with vessels of the "Bag-In-Box" BIB (14) type for their delivery, such system or kit (1) being adapted to perform the placement and connection of the BIB vessels (14) on the delivering device (12), and comprising: a main body (4, 17, 18); a plate (3, 16) adapted to place thereon at least one BIB vessel (14); a connector (10) and adapted to be connected with a delivering tap of a BIB vessel (14); a plug (8) adapted to be connected to a PIN (13) of the delivering device (12); a connecting tube (4.1, 17.1, 18.1) placed in the main body (4, 17, 18) and connected to the flexible hose (9) for communicating the BIB vessel (14) with the delivering device (12); and a check valve assembly (6, 7) for preventing liquid from re¬entering into the main body (4, 17, 18).

20 Claims, 27 Drawing Sheets

(56) References Cited

U.S. PATENT DOCUMENTS

| | | | | |
|---|---|---|---|---|
| 5,577,638 | A * | 11/1996 | Takagawa | B67D 3/0019 222/105 |
| 6,568,570 | B1 * | 5/2003 | Amberg | B65D 1/0292 222/207 |
| 6,588,630 | B2 * | 7/2003 | Tan | B67D 1/1247 222/185.1 |
| 7,775,397 | B2 * | 8/2010 | Rivard | B67D 3/0025 141/303 |
| 8,459,509 | B2 * | 6/2013 | Bui | B01L 3/0265 222/207 |
| 9,227,828 | B2 * | 1/2016 | Groesbeck | B67D 3/0067 |
| 2018/0273371 | A1 * | 9/2018 | Nini | B67D 3/0029 |

* cited by examiner 10
2
9
18
16
6
11
1

2
16
10
18
9
1
6
11
8

10
16
2
9
18
6
8
1
11
6
8
1
11

DELIVERING DEVICE OF LIQUIDS FROM WATER CROCKS EQUIPPED WITH A SYSTEM OR KIT FOR REPLACING WATER CROCKS WITH VESSELS OF THE "BAG-IN-BOX" TYPE FOR THEIR DELIVERY

The present invention refers to a delivering device of liquids from water crocks equipped with a system or kit for replacing water crocks with vessels of the "Bag-In-Box" BIB type for their delivery. In particular, the invention refers to a system which allows adapting and connecting Bag-In-Box (herein below also called "BIB") vessels to a "normal" delivering dispenser of liquids, preferably water, from water crocks made of plastic material present on the market.

This system, herein below also called "Kit", will be manufactured in plastic material to be able to "transform" the normal water delivering devices, preferably devised for supporting and allowing the delivery from rigid water crocks, into water delivering devices useful to receive semi-flexible and flexible vessels of the Bag-in-Box type and other stand-up pouch types or the like, and anyway all types of semi-rigid and flexible vessels subjected to the direct action of the atmospheric pressure. Such system or kit will have to be placed on dispensing device for water crocks existing on the market, in the area where usually the water crock made of PET or other plastic materials is placed (upside down), and will allow the continuous connection of one or more of such vessels.

The new kit which will allow placing BIB on existing batching dispenser devices will be wholly made of plastics, and therefore will be wholly recyclable at the end of its life.

Currently, the system which allows using water crocks (or other vessels) has numerous problems which will be partly solved with the use of the inventive kit, which will de facto allow removing such water crocks.

In order to better understand the advantages provided by the use of the BIB technology compared with the one providing for the use of the water crocks, the manufacturing cycle of the water crocks will necessarily have to be analyzed, which comprises the following main steps.

Primary Production

Water origin/Safeguard of water sources

Entry of Goods

Water Treatments

De-ironing/Softening/Pre-filtering/Filtering/Mineralizing/Ozonizing

Bottling and Sealing of the Vessels

Vessel cleaning and check: a) removal of the plug; b) visual inspection; c) first rinse with water (up to +65° C.); d) rinse in hot water (+45/+65° C.) with acid or basic detergents; e) sanitation by means of cold water added with sanitizing agent/oxygenated water or ozonized water.

Bottling and sealing the package (contact tank): before bottling, the tank water can be added with ozone or mineral salts. During bottling, it is important to check the concentration of ozone present in water. It is possible to disinfect the plugs with ozonized water and the hollow space between water and plug can be filled with nitrogen.

Final Manufacturer Product/Initial Manager Product

Final product: in order to exclude the presence of ozone in water after bottling, the water vessels are stayed for at least eight hours, before being dispatched. This danger is bypassed in that the produced water batch is not handled till the analyzing laboratory provides the compliance with such production.

Storage

Transport

Distribution

Cleaning and sanitizing the water delivering devices: for the water delivering devices, the advised timing (from Italian and European experiences in the sector) is of a step of cleaning and sanitizing (or tank replacement) at least every six months. Where it is needed (installation of delivering devices in particular environments, such as workshops, food preparation, etc.), it is advisable to more frequently intervene with a timing which every manager must evaluate depending on his experience. Maintenance of the delivering devices must be performed at least once a year and must deal with the replacement of worn parts (air filters, gaskets, etc.).

Check and Selection of Returned Items

TO reduce the risk of contaminations to a minimum, it is advisable to store full and empty water crocks in a clean, dry and fresh place, repaired from polluting sources, atmospheric agents in general (direct light, heat, rain, etc.), and avoid dusty places and any contact with animals. Empty vessels must be stored and returned healthy both by the customer, and by the manager, and therefore must be used with care. Empty water crocks, which return from customer to distributor and from distributor to supplier, must be grouped and protected from external contaminations, possibly on suitable structures, till their use. Before being inserted in a new filling cycle, they must be selected through visual and olfactory inspections by trained operators and/or suitable sensors (sniffers), which verify the integrity of the packages, the absence of anomalous colorations and odors (deriving from improper uses, such as filling with different substances from water). This is a danger not to be underestimated, because the health guarantee of this production line depends on its hygienic quality. As first preventive measure, water crocks with tampered plug-sealing mechanism should be discarded. Complying empty water crocks are inserted in the production chain, while non-complying ones are removed and the customer is charged with possible penalties (empty product cost, etc.).

Synthetically: the empty vessel must be stored and returned healthy both by the customer, and by the distributor, and therefore must be used with care and it is absolutely forbidden to:

- damage it with various types of impacts (weakening of water crock plastics)
- mark it with fountain pens, paints, etc.
- tamper with the safety plug
- fill with any foreign liquid/material (oil, petrol and other solvents).

Actually, this is a round cycle, which has a circular flow: after bottling, packaged products must be stored protected from frost, in a closed and vented environment, and with temperatures of +10/+20° C.

Since the vessels, upon going out of the plant, are cold and humid, it is necessary to ensure a good natural and/or artificial venting, in order to prevent forming molds on the label and on the packaging.

Packaging is performed in loads with different compositions; a colored heat-shrinking film is more and more used to provide a further protection of the product during its transport and storage.

As regards the distribution of water crocks and delivering devices to managing companies and to customers, the final product should be packaged in order to be protected during its handling and transport.

Transport must be performed with suitable, clean and closed means. During the delivery of delivering devices and water to customers, the following items must be taken into account:

- the water delivering device must be wound many times with a transparent film to reduce the dangers of contamination;
- the water vessel and the delivering devices must be kept unmoving in the vehicle, to be delivered to the customer without damages and clean.

This type of vessel however has various problems: in the water distribution field, further wastes are given by empty bottles and water crocks, which can follow different routes according to the type of material of which they are made.

The first type is "VAR", abbreviation of "empty bottle to be returned", glass bottled to be used after its sanitizing. Its washing is a big problem: in fact, continuous checks must be performed, together with a selection of empty bottles returning in the cycle; moreover, there are the dangers of breakage, excessive weight and collection and recycle costs, which make their management very burdensome.

The second type is "VAP", abbreviation of "empty bottle to be dispensed with", glass bottle to be removed in suitable caissons for a differential collection.

The third type is "PC", abbreviation of "Poly Carbonate", plastic material of which some water vessels are made, in particular water crocks, used for water refrigerators. The VAR is also provided here. This because it is a very resistant polymer to impacts and heat, transparent, non-toxic. In spite of this, it is being replaced with PET, for economic and managing reasons: continuous checks must be performed upstream (with selection of empty bottles, which re-enter the cycle) and it has a managing cost with the same problems of the glass bottles to be returned.

The fourth type is "PVC", abbreviation of the technical denomination of "Poly Vinyl Chloride, plastic material of which some types of bottles are made, used for water. In this use, it has been gradually replaced by PET, more transparent and resistant, less permeable to gas (and, therefore capable of being used also for carbonated water), but also for its lower production cost.

The fifth type is "PET", abbreviation of the technical denomination of "Poly Ethylene Terephthalate", plastic material of which the majority of water and beverage bottles is made. The use of this material has implied the drastic lowering of transport and production costs, with respect to traditional glass bottles, in addition with the undoubted advantages of lightness, handling capability, safety.

Recycling of plastic vessels for liquids can be performed in several ways. To obtain homogeneous plastic objects, vessels must be separated depending on the polymer of which they have been made (PET, PVC).

If the selection process is not performed, objects made of heterogeneous recycled plastics will be manufactured.

In both cases, collected vessels are subjected to a first treatment process for extracting possible other types of wastes, washing, crushing and their following working.

Other known problems are as follows:

- the water crocks can be filled, since their closures have no tamper-preventing systems, and therefore products (beverages) not certified by manufacturing companies could be put on the market;
- being reusable, the vessels must necessarily return, after their use, to the filling center to be sanitized;
- the consumer must pay a high amount, such as when damaging the vessel, when he purchases the beverage in these water crocks;
- also the manufacturer must pay a high amount of money, since he will have to support expenses to transport the full vessel, but also for taking back the empty vessel to his company;
- moreover, managing and washing cost also fall on the end customer;
- at "carbon footprint" and ecologic level, the water crocks have a heavy impact on the environment, due to their transport (of a fill bottled and the return of the empty bottle) and their washing (with great uses of water and disinfectant);
- water crocks have a warranty seal which must necessarily be changed at the end of every use (obviously after washing and sterilization);
- water crocks, being reusable, must necessarily go back to their filing center, must be disassembled and sterilized: therefore, there will be high managing costs both on the fill bottle, and on the return empty bottle.

Object of the present invention is solving the above prior art problems, by providing a delivering device of liquids from water crocks equipped with a system or kit for replacing water crocks with vessels of the "Bag-In-Box" BIB type for their delivery in an ecologically efficient, economic, simple and immediate way.

Such kit for placing BIB system on existing liquid dispensers has been designed for placing BIB vessels with mono-directional use, that therefore do not need their withdrawal for washing them and fill them again: at the end of their use, they are thrown in the vessel for recycling plastics and cardboard (bag and tap made of plastics, and external box made of cardboard).

The vessel is usually available with mono-directional taps, with low cost, which allow being connected to a connector system suitably developed by the Applicant of the present invention in document EP-A1-1627850.

The BIB offers a significant improvement in sales and marketing of the volume of liquids, in this case water.

It opens new channels and markets, and provides a step change in environmental performances—as well as reducing costs and improving the cash flow.

The advantages of using a BIB with respect to water crocks include reduced total costs of possible bottles, reduced environmental impact, new market opportunities and easier short-term response to demand peaks and depressions.

There is potentially a big saving in invested capital, removing the need of keeping a "fleet" of water crocks.

Removing the fleet, high sums can be freed, linked to this goods and damaged, lost or stolen water crocks can be dispensed with.

Moreover, there is no further need of keeping the costly systems for tracking the water crocks.

The environmental benefits, key of the BIB, include: low use of materials with respect to water crocks, and lightweight construction which reduces environmental impacts.

Moreover, there is a higher flexibility in choosing the liters of liquid to be transported.

BIBs are completely and easily recyclable, satisfy all essential requirements covered by Community Regulations, among which suitability both for mechanics, and for recycling 'waste energy'.

Using BIBs, real benefits are obtained for end users.

One of the biggest advantages is the reduced storage space necessary for BIBs: safely storing empty water crocks to prevent them from being stolen before being collected is a problem in many sales points.

BIBs can be easily squashed once they are empty, in order to afterwards place them in a basket with other recyclable plastic and paper materials.

The above and other objects and advantages of the present invention, as will result from the following description, are obtained with a system as claimed in claim 1. Preferred embodiments and non-trivial variations of the present invention are the subject matter of the dependent claims.

It is intended that all enclosed claims are an integral part of the present description.

The present invention will be better described by some preferred embodiments thereof, provided as a non-limiting example, with reference to the enclosed drawings, in which.

Figure 1:
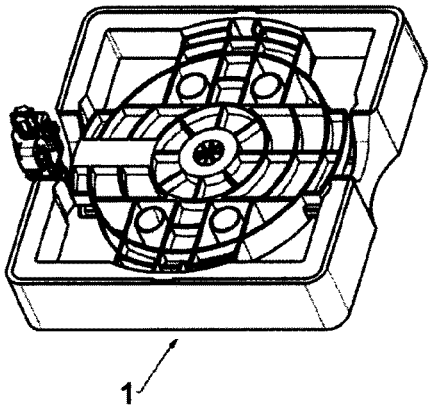
FIG. 1 is a perspective view of an embodiment of kit Model 1 for Closed Systems with the system with optional balance according to the present invention.
Figure 2:
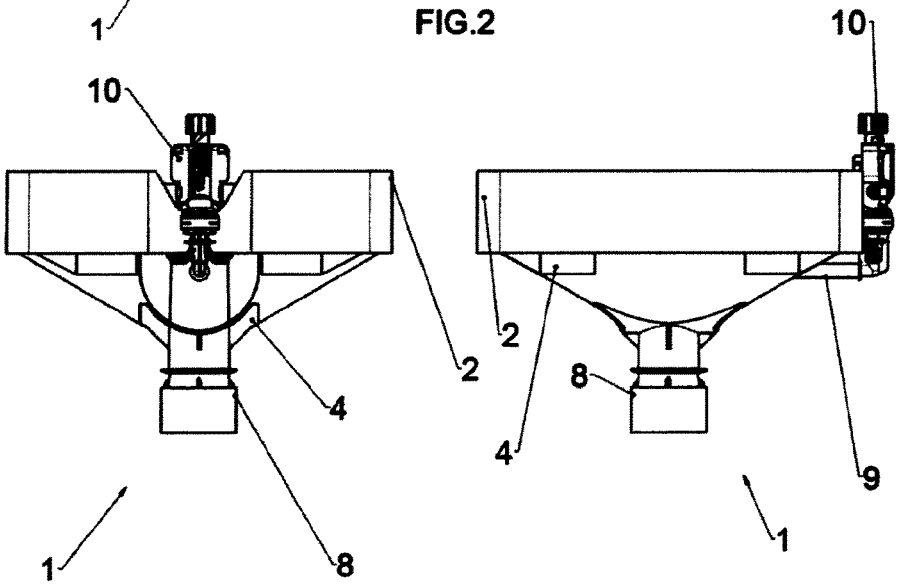
FIG. 2 is a side and front view of kit of FIG. 1.
Figure 3:
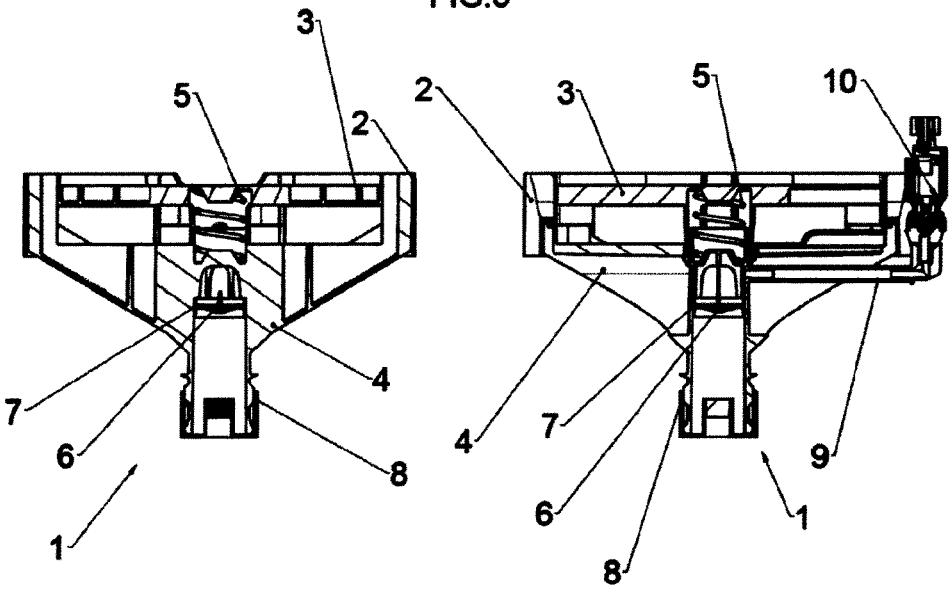
FIG. 3 is a sectional view of kit of FIG. 2.
Figure 4:
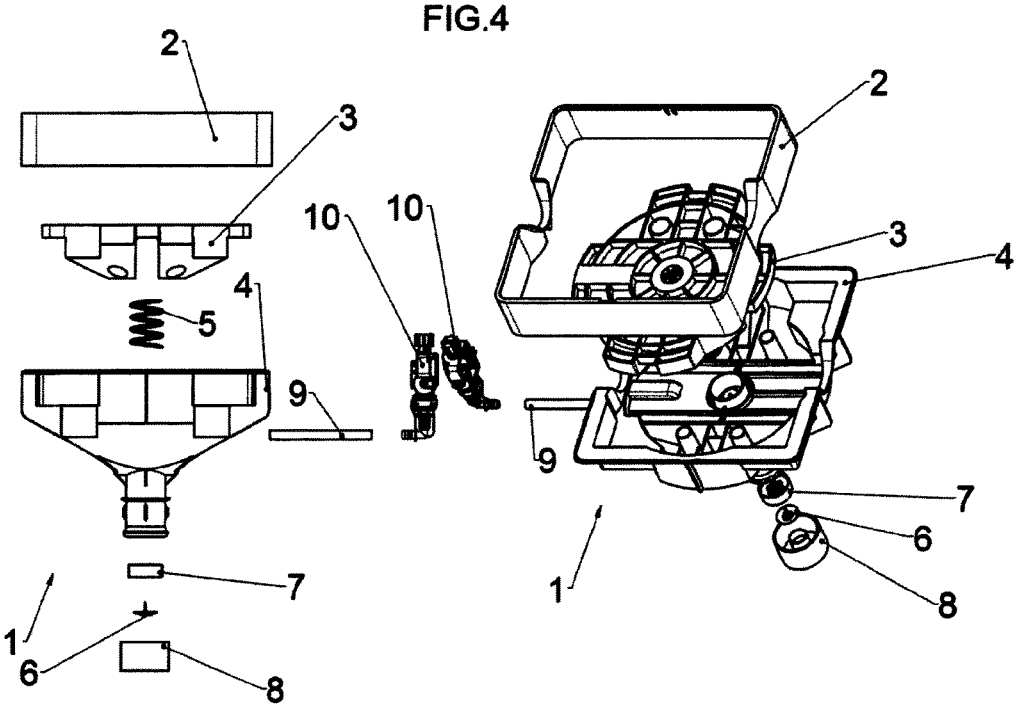
FIG. 4 is an exploded view of kit of FIG. 1.
Figure 5:
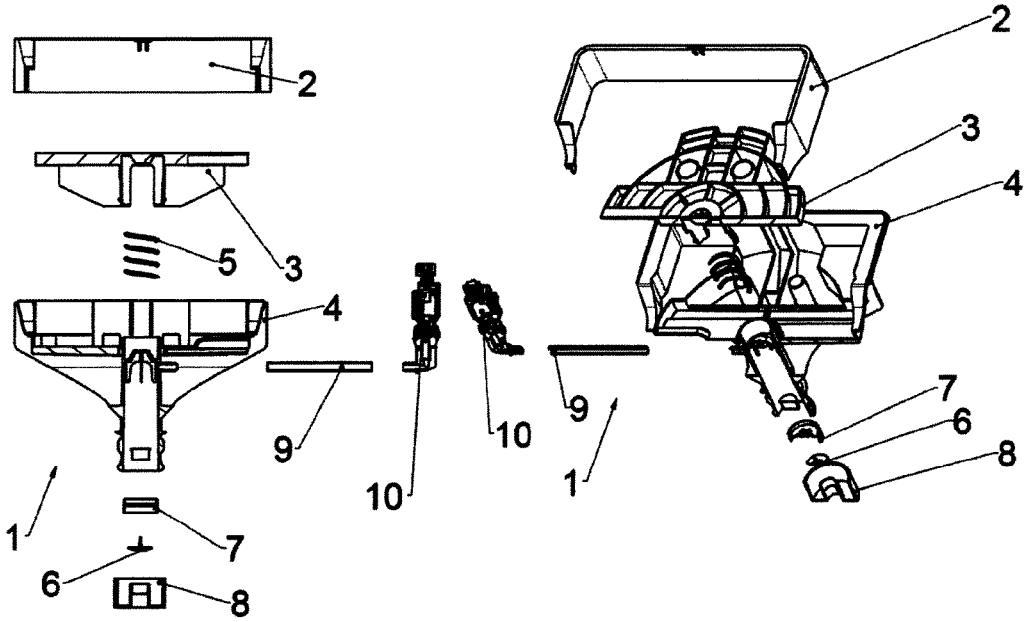
FIG. 5 is an exploded sectional view of kit of FIG. 1.

BIBs, as previously stated, are equipped with a tap which will be connected with the connector (described above) designed for the delivering tap present on the BIB system.

The connector in turn will be connected to a main body which in turn will be connected to the water dispensing device or water cooling device ("water dispenser" or "water cooler").

In the main body, the position of a small connection tube of the flexible hose (namely lateral or axial-central) will also be the discriminating feature of such invention to distinguish Model 1 and Model 2 and will allow covering the whole marked for water dispensers depending on its shape, as will be described below.

Model 1 will have a side connection for flexible hose with a profile which exactly mimics the geometry of the water crocks, and therefore will have the chance of placing on the same body a standard safety plug for the direct connection to PINs 13 present on some models of water dispensers 12, such as for example the Bericap plug 8, which is normally used as base/example for the other manufacturers. Model 1 will have the chance of changing the geometry of the lower part passing from the one similar to water crock necks to be able to provide a seat of the plug 8, model "valve lock" type Bericap, a geometry for the seat of a big OR-ring 15 useful for the direct connection to the tank of the water dispenser 19 not equipped with connection PIN 13 (not shown).

Model 2 will have a profile adapted to receive a special gasket which will allow to be directly connected, as will be described, to the internal tank 19 of the water dispenser when this latter one is not equipped with the connection PIN 13 of the above described plug 8.

Model 2 with connection for vertical axial flexible hose (like for Model 1) will have the chance, by only changing the lower part (and therefore having a single mold capable of producing both main body versions 17 and 18) of producing the Model 2 version with the lower part with geometry of the water crock neck useful to receive the plug 8 and therefore capable of be directly connected to water dispensers with systems with PIN 13 and air passage "protected" by a filter and a liquid check valve.

Everything will be better described below.

On the main body it will be possible to place (in one of the two versions and to be deemed as optional, but shown only for Model 1) a plate 3 useful to rest the different formats (in terms of liters contained inside) of BIBs 14 and will be equipped with a system which will allow weighing the BIB 14 (due to a calibrated metallic spring 5 placed between plate 3 and main body 4 (as will be described below) and will allow the user to understand when it will be necessary to replace the BIB 14 itself since it is empty. Alternatively (and this is valid both for Model 1 and for Model 2, but in this case it will be shown only for Model 2), there will be instead a plate system 16 constrained to the main body 17 through a hinge, which will allow inspecting the connection system between the connector 10 (connected to the BIB 14) and the main body 17. Obviously, it will be possible to create also on the second type of kit, the balance system with trivial geometric modifications, but since it has to be deemed as a possible additional optional, it will be described only for one of the two systems, namely only on Model 1.

In order to better comprise the innovation which will be inserted by the new system or kit 1, it will be advisable to describe the two types of delivering devices which, generically speaking, are on the market, namely the "Open System" delivering devices (FIG. 57) (from now on called "delivering devices SA") and the "Closed System" delivering devices (FIG. 56) (from now on called "delivering devices SC").

It is advisable to specify that the main difference between the two systems is that the delivering devices SC are equipped, on their venting hole (useful when the rigid water crock is placed on the delivering device, since without it, liquid could not go out of the water crock which will go in depression), of a check valve useful to enable the creation of a continuous flow for having a constant delivery of liquid from the water dispenser 12 (air enters in the rigid system of the water crock and liquid goes out of the water dispenser in a closed system). The venting hole in the delivering devices SC, and consequently the seat of the check valve 6, are generally obtained on the PIN connection cone of the delivering device to the system which is used to operatively connect the Bericap "valve-lock" model valve 6.

Such check valve device will also have the function of filtering air coming from outside (with costly, but necessary, filters) to avoid its contamination. Afterwards, it will be better seen that these check valves play an essential role for the connection of kit Model 1 and of kit Model 2 in its version with safety plug 8 since, being the BIB (differently from rigid water crocks) always subjected to the external atmospheric pressure, the check valve present on the water dispenser will help blocking water from going out of the delivering device towards outside. Obviously, in order to have a closed system, it will be necessary, as will be described below, that the water dispenser is equipped with a PIN system 13 for the air-tight connection with the suitable safety plug 8 (of the Bericap type) placed on the water crocks, and obviously the two types of kit with lower part with water crock type profile useful to connect the plug 8.

In this case, kit Model 1 for SC (FIGS. 1 to 6) and kit Model 2 for SC (FIGS. 43 to 49) will be created.

Instead, the delivering devices SA, by exploiting the Pascal principle, namely a water crock full of liquid (water in this case) completely overturned on a tank full of liquid (water in this case) (or which anyway will be filled with liquid if it is its first use) will receive a pressure transmitted by the liquid in the tank 19 (atmospheric pressure) which will also be transmitted to water at the bottle mouth, pushing it upwards: consequently, water in the bottle cannot go out.

In this case of delivering devices SA, the tank 19 can be present "free" from any connection member (like the connection PIN 13 to the safety plug 8 present on the water crock) and then in this case, before overturning the water crock on the open tank of the delivering device SA, it will be necessary to remove its plug 8, or, if there is a delivering device SA but with connection PIN 13 (but without the check valve 6 on the PIN 13 itself, which is, as stated, the main discriminant between SA and SC), on the water crocks there will be the safety plug 8 with automatic opening (due to the delivering device PIN 13), but the delivering device SA will always operate with the Pascal principle (since the safety valve is not present on the PIN 13).

Sometimes, when it happens that there is a PIN 13 not equipped with safety valve on the air entry hole (which will always be present on water dispensers since they are designed to operate/deliver liquids from rigid vessels of the water crock type), this will be removed to allow having the necessary space for placing and exploiting one of the two Models of the present invention for Open Systems (then, it will be decided whether the system has to be kept open or be transformed into a closed system by using the OR-Ring 15) namely the connection of the floating module 11 (if a kit is used with lower part shaped as a bottle neck with plug 8)

or change shape to the lower part of the main body, in order to be able to insert the OR-ring 15 and sealing directly on the tank 19.

In this case, usually, as instead happens on delivering devices SC, there are no check valves, and therefore it will be necessary to follow two different paths: one provides for the use of a floating device 11 to be externally connected on the plug 8 in Model 1 and in Model 2 with the lower part with water crock neck geometry and plug 8 (after having prepared the water dispenser to be able to receive the device of Model 1 and of Model 2 with the lower part with water crock neck geometry and plug 8 for SA with floating module 11, namely the removal of the PIN system from the water dispenser itself). In this case, kit Model 1 for SA (FIGS. 7 to 11) and kit Model 2 for SA (FIGS. 50 to 55) will be created.

The check valve 6 present on last-generation dispensers SC (FIG. 56) usually has the function of limiting and filtering (sometimes there is also an air-purifying filter in addition to the valve itself) air that will have to enter the system (and the water crocks themselves) to allow the delivery of liquid.

In fact, it is necessary to take into account that, when a rigid water crock is placed on the delivering device, it will be necessary that, in order to allow a regular delivery, when spilling liquid from the delivering device, air simultaneously enter into the water crock, in order to create the right pressure which will allow liquid to go out.

Contrary to the rigid water crock where entry of air is necessary to enable liquids to go out, the BIB systems 14 do not need venting holes to operate the system, since the flexible bags contained inside the cardboard box (BIB) will always be subjected to atmospheric pressure, which collapses them onto themselves allowing a continuous delivery.

Certainly, in this way there will be problems when the venting holes of the delivering devices are not equipped with a check valve (which, in case of use of BIB systems 14, will block liquid from going out of the system since, differently from water crocks which have rigid walls and therefore not subjected to atmospheric pressure, the internal bags of the BIB 14 will always be subjected to such pressure, and therefore, when there is no check valve, liquid will go out of the venting holes).

It will be described below that, for the delivering devices SA (FIG. 57), there will be an additional device 11 which will allow removing the problem of the delivering devices SA, or a modification to the main body 17, which will allow creating a sealed (and pressurized) SC between kit 1 and water dispenser 12.

It must also be added that the use of systems with BIB 14 on standard delivering devices (once having solved the problems implied by delivering devices SA) will provide a very big advantage with respect to the use of water crocks, since water will never get in contact with external air (instead necessary for water crocks with rigid walls to enable the delivery of liquid) and in general, as will be seen, there will be a sort of "sealed circuit" which de facto thereby completely remove one of the big problems of the delivering devices with water crocks, namely pollution from external agents.

With the BIB 14 a closed system will be created, which cannot be attached by external polluting agents.

The annoying problem will also be eliminated of having to clean the external surface of the water crock (which, during its transport, gets dirty outside) above all if the water crock is then placed on an open system without the connecting PIN (FIG. 56) (in this case, if one forgets cleaning the external surface of the water crock, this will get in contact with water present on the tank polluting it).

The system with BIB 14 will never have this type of problem, since water will never get in contact with the outside vessel, preserving it from any source of pollution, both in water dispensers with Open System, and in water dispensers 12 with Closed System, since there will always be an element in the middle (kit 1) which will preserve from the direct contact BIB 14 and water dispenser 12.

Therefore, the system with BIB 14, in addition to save money in terms of purchase of additional components necessary for preventing the pollution of delivered water, namely of very costly air filters to be placed after the check valve 6, will contribute to prevent the pollution due to the contact between dirty external surface of the vessels (especially on the Open Systems) and water to be delivered.

With reference to the Figures, the two preferred embodiments of the system or kit 1 of the present invention are shown and described. It will be immediately obvious that numerous variations and modifications (for example related to shape, sizes, arrangements and parts with equivalent functionalities or the fact of creating in a single mold both version by exploiting the parts in common between the two kits) could be made to what is described, without departing from the scope of the invention as appears from the enclosed claims.

Figure 14:
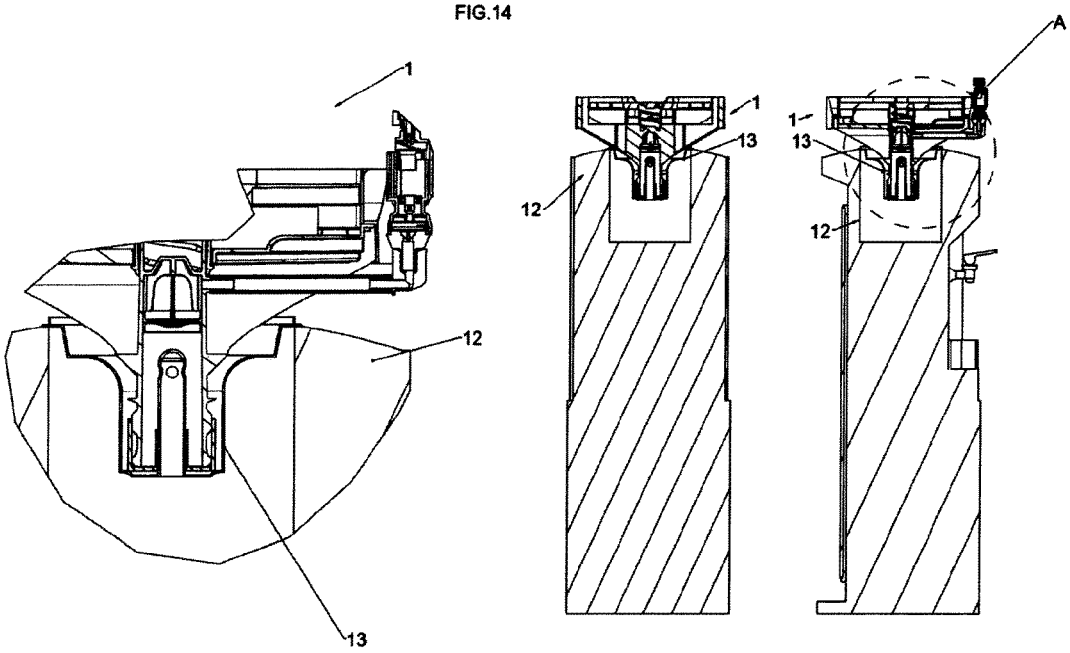
FIG. 14 is the sectional view of kit of FIG. 13 with the detail of connections.
Figure 15:
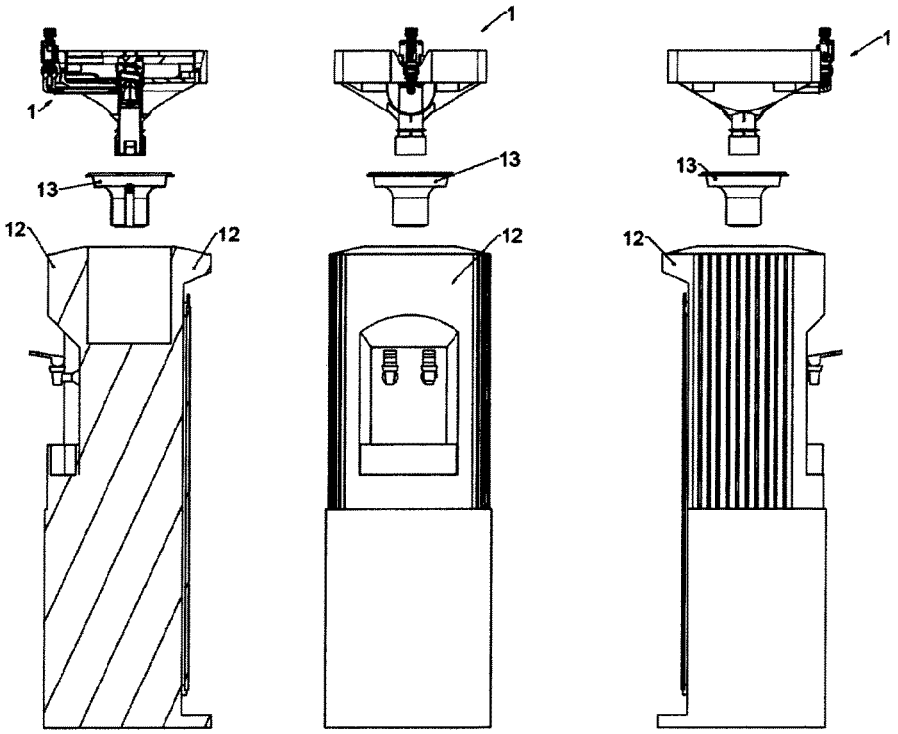
FIG. 15 is an exploded front, side and sectional view of kit of FIG. 13.
Figure 18:
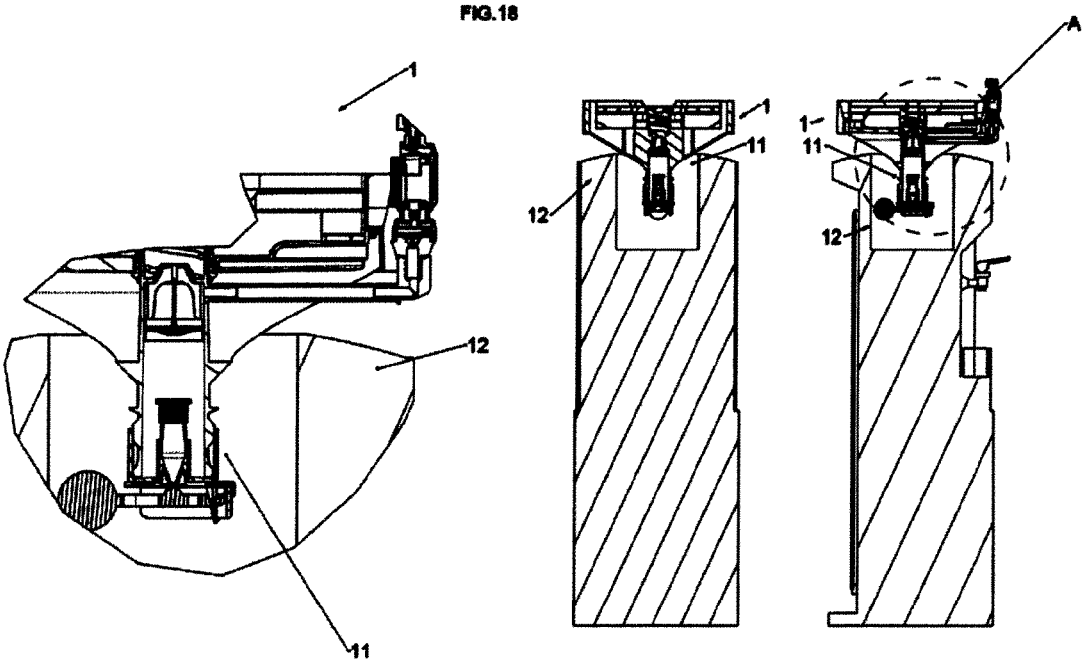
FIG. 18 is the sectional view of kit of FIG. 16 with the detail of the connections.
Figure 19:
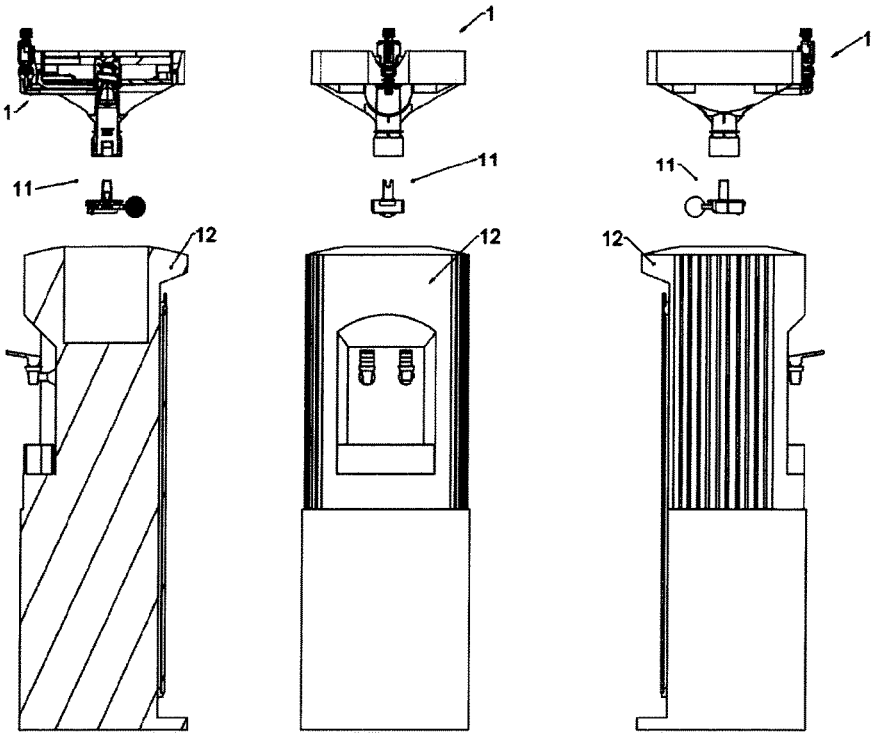
FIG. 19 is an exploded front, side and sectional view of kit of FIG. 16.
Figure 26:
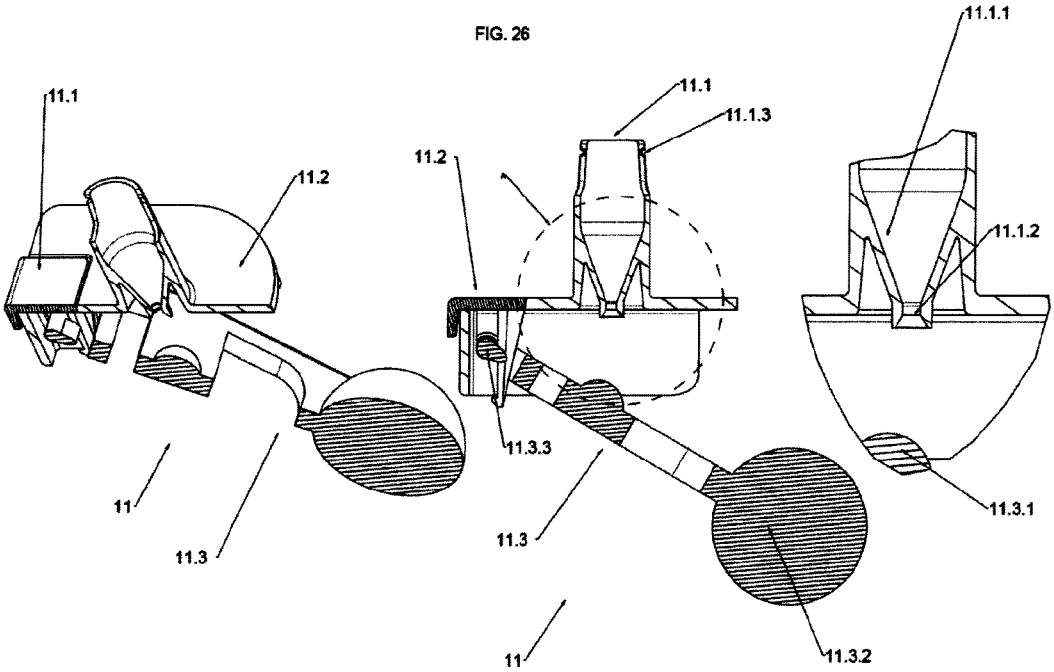
FIG. 26 is a perspective side and detailed view of the section of the floating module for Model 1 for Open Systems in an open position.
Figure 27:
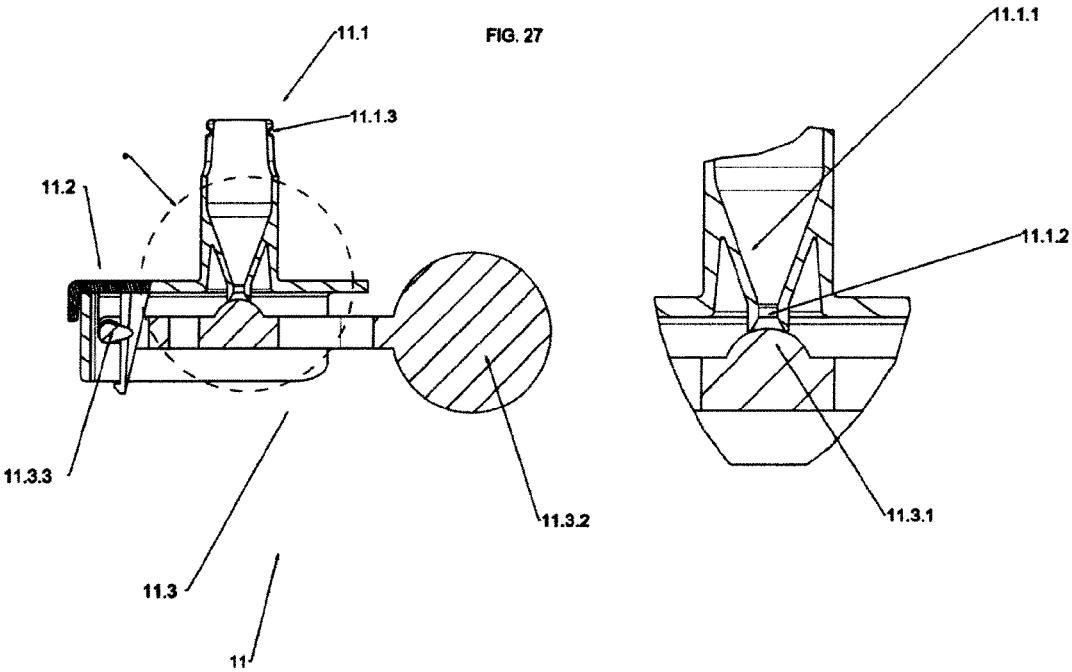
FIG. 27 is a sectional side and detailed view of the floating system in a closing position.
Figure 28:
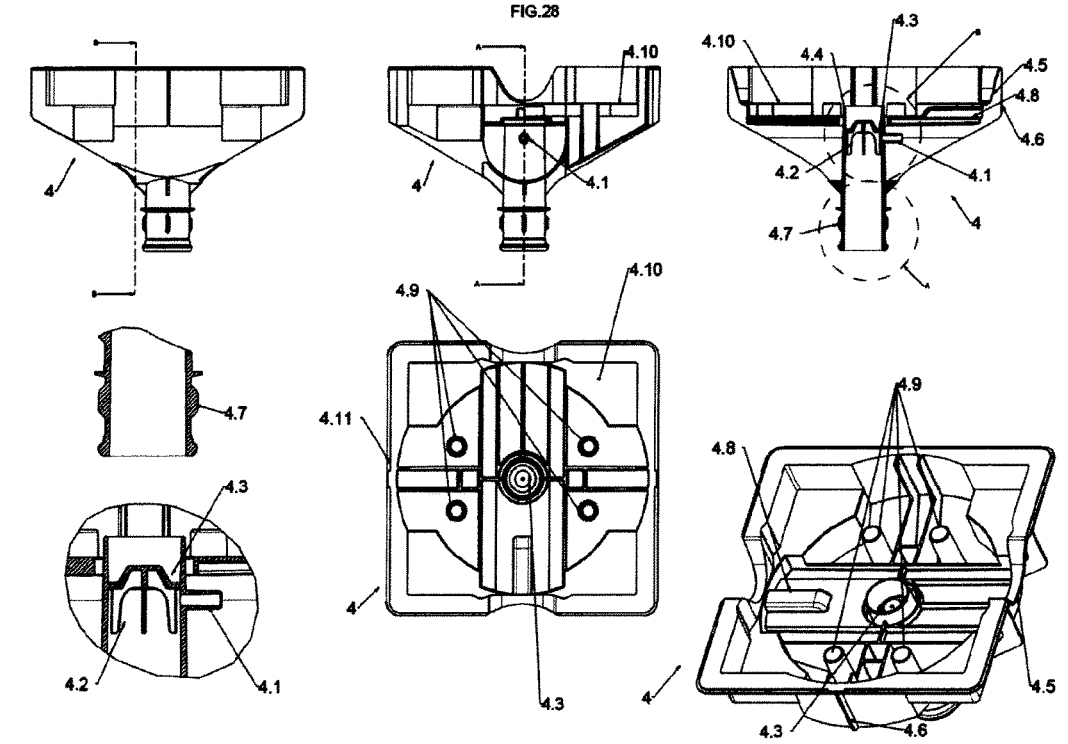
FIG. 28 is a perspective, side, front, upper and detailed view of the main body of Model 1.
Figure 29:
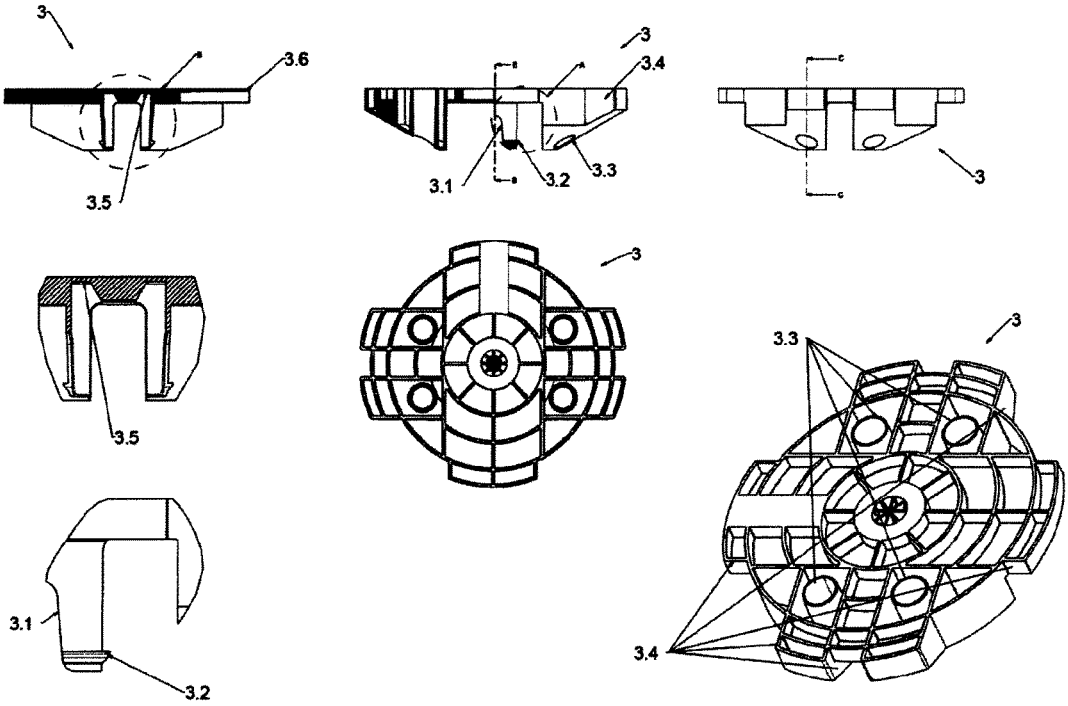
FIG. 29 is a perspective, side, front, upper and detailed view of the plate of Model 1.
Figure 41:
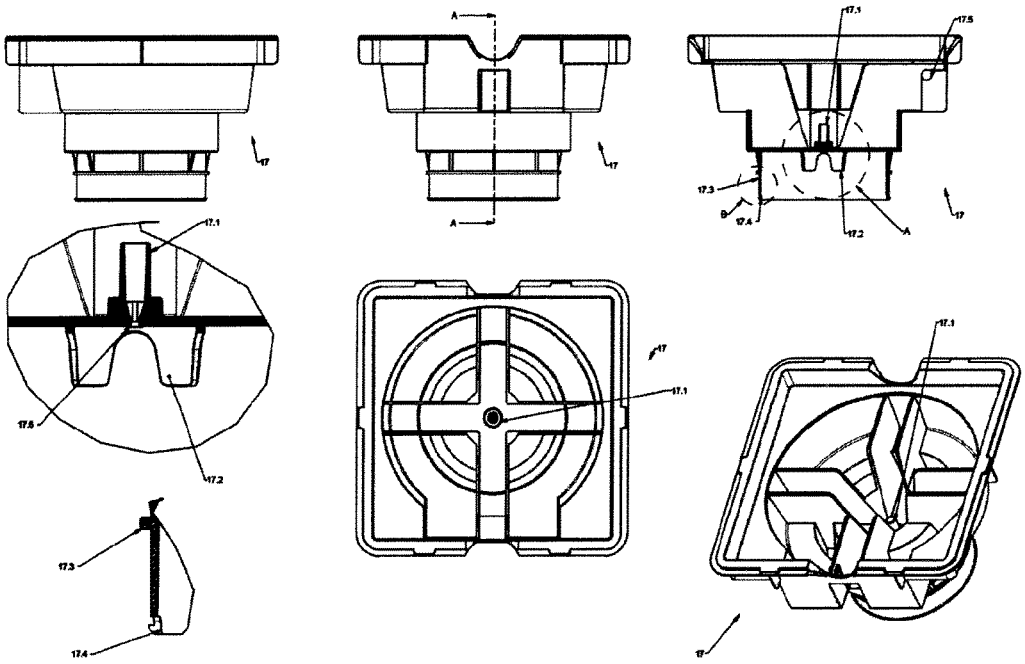
FIG. 41 is a perspective, side, front, upper and detailed view of the main body of kit Model 2.

According to the Figures, the system or kit 1 to be adapted on current water dispensers 12, first of all comprises a main body 4, 17 (Model 1 is shown in FIG. 28, while Model 2 is shown in FIG. 41) of an enlarged and elongated shape on the upper part of the piece and with an elongated wall in the lower part, adapted to be correctly connected to the water dispenser 12 or by means of a plug 8 of the "valve lock" type (for example, the Bericap model) if there is a system with PIN 13 with check valve 6, as shown in FIG. 14 and in FIG. 15, or by directly inserting the elongated body of Model 1 on which the floating module 11 will be assembled, shown in FIGS. 24, 25, 26 and 27, on the tank of the water dispenser, as shown in FIG. 18 and in FIG. 19. On the Model 1 the lower part can be shaped to receive the OR-ring 15 for a direct seal on the dispenser 12.

If instead there is kit Model 2, the same will be directly connected to the tank 19 of the water dispenser 12 and everything will be sealed due to a special gasket 15 or, if there is Model 2 with its lower part shaped as the neck of a water crock useful to receive Bericap valve lock plug 8, there will be the same chances of connection shown for Model 1 (namely a direct connection through PIN 13 or with floating module 11) as shown from FIG. 43 to FIG. 55.

Now, in order to better describe the two kit geometries (Model 1 and Model 2), they will be described herein below individually, pointing out also the single components and features connected thereto.

Starting from kit Model 1 with lateral small connection tube, FIG. 28 shows a body 4 which substantially has internal and external geometries which are used to block and/or contain all devices and pieces adapted to create a kit 1 with the BIB 14 which will be placed above.

Figure 30:
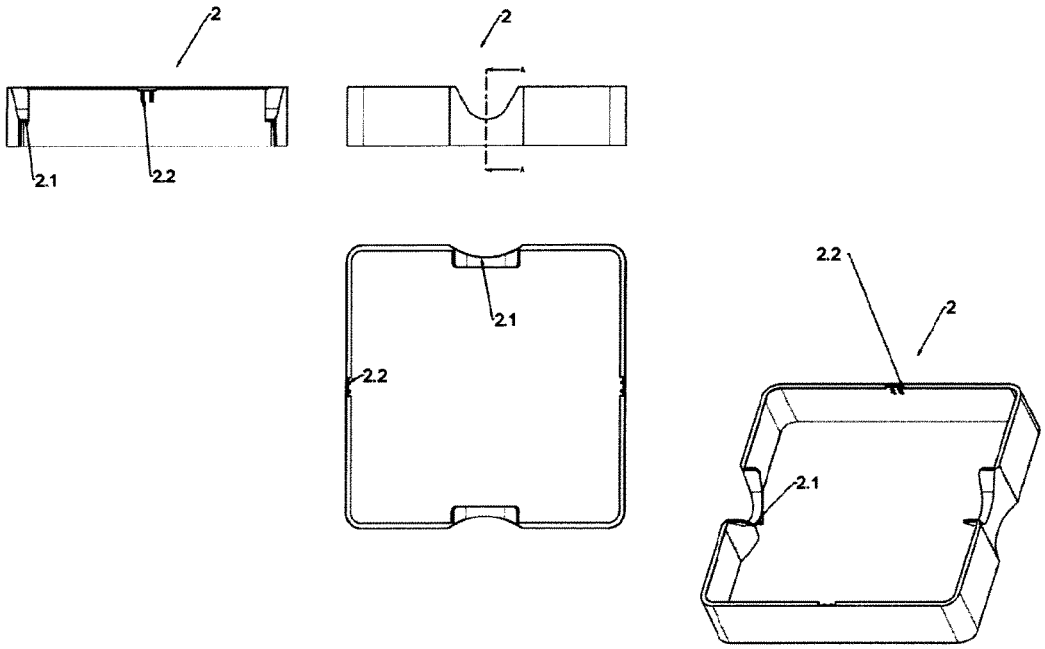
FIG. 30 is a perspective, side, front, upper and detailed view of the cover usable both for Model 1, and for Model 2.

Starting from the upper part of the main body 4 and with reference to FIG. 28, walls 4.13 can be observed, adapted to contain and guide the BIB 14 placed above the kit 1. The wall 4.11 is equipped with a stiffening edge, which follows the wall profile by stiffening it and creating the seat, as can be seen afterwards, for the interchangeable cover 2 shown in FIG. 30. The external part of the cover 2, which will be the part visible by the end customer/user, can be used as seat to be able to place aesthetic adhesives (logos or other advertising graphics) thereon.

Inside the main body 4, there is a plane 4.10 which will be useful if one decides not to exploit the balance system with plate 3 and calibrated metallic spring 5 (shown below), since, by cooperating with the cylinders 4.9 as vertical guide and the ribs 4.12, it will create a rigid support/guiding area for the BIB 14. The ribs 4.12 are adapted to confer to the piece the necessary stiffness/structure to support the weight of the BIB 14 which will be placed above. Mainly, they will be first hollow supporting geometries 4.9 or ribs 4.12, which will structure the piece without making it heavier and above all without having the need of thickening too much the piece wall, since this would cause an excessive use of plastic material, which will highly increase the price of the molded product (cost of plastic material and cycle time for producing it elongated). Openings (two opposite openings) 4.5 can be seen, useful for placing the delivery tap on one side or the delivery tap on the connector (connected to the water dispenser) on the other side.

Moreover, it can be noted that the two geometries are contrasted, since, as previously stated, the end user must be given the chance of connecting the delivering tap of the BIB 14 to the connection system present on the kit 1 itself, and then connect it to the water dispenser 12, or decide whether, once having placed the BIB 14 at 180° with respect to the connection area of the connector 10 present on the kit 1, directly delivering liquid by exploiting the delivering tap present on the BIB 14 without necessarily connecting it to the water dispenser 12 by means of the connector 10.

It must further be noted that the conical supporting geometries 4.9 which can be found inside the main body 4 also have a guiding function of the upper plate on which a supporting plate 3 will be inserted, which will be the real base on which the BIB 14 rest when the balance system of Model 1 will be used. The geometries 4.9 which in this case will operate as guides for the above plate 3 will cooperate with the geometries 3.3 of the plate 3.

It must be remembered that, between the body of kit Model 1 and the plate 3, the calibrated spring 5 will be placed, adapted to detect the right weight of the BIB 14 placed above and to determine the height of the plate 3 with respect to a zero position computed when the spring 5 is as a package (FIG. 20 and FIG. 21) and the plate 3 is placed as low as possible.

Figure 20:
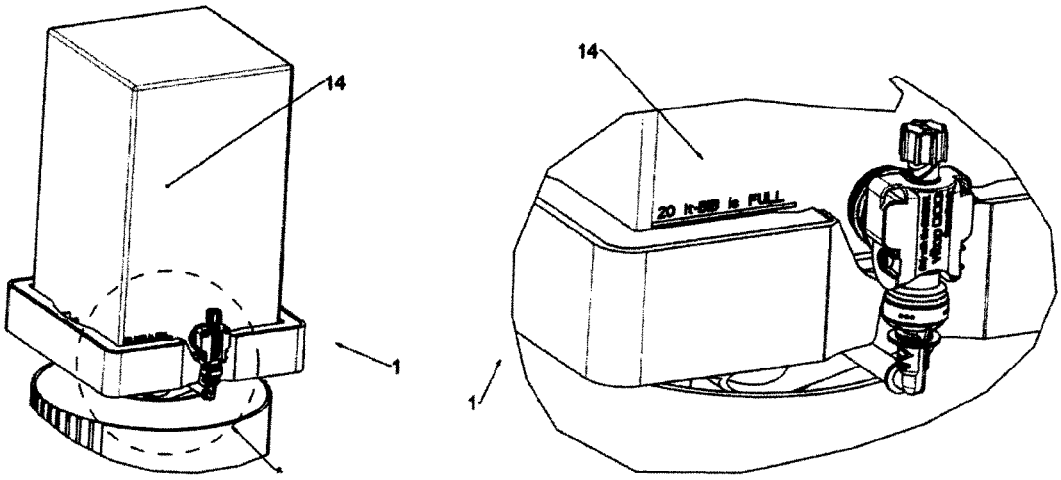
FIG. 20 is a perspective view of kit of FIG. 16 and a detailed view of the system with balance when the BIB is full of liquid and the plate compresses the calibrated spring.
Figure 21:
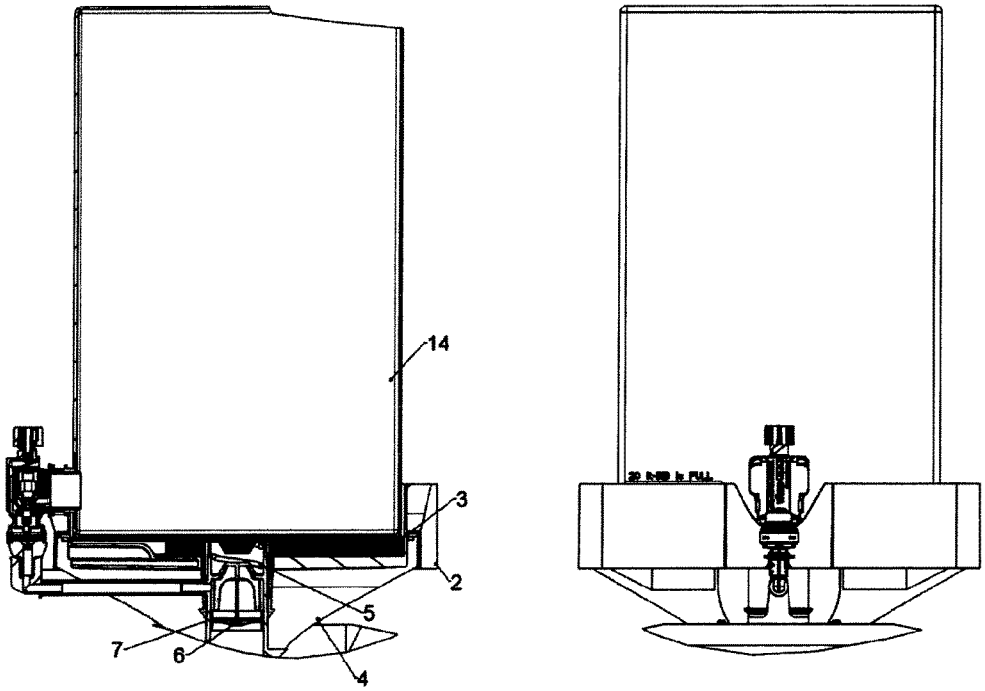
FIG. 21 is a front and side sectional view of kit of FIG. 16 to point out what happens when the BIB is full of liquid and the optional system with balance is compressed.
Figure 22:
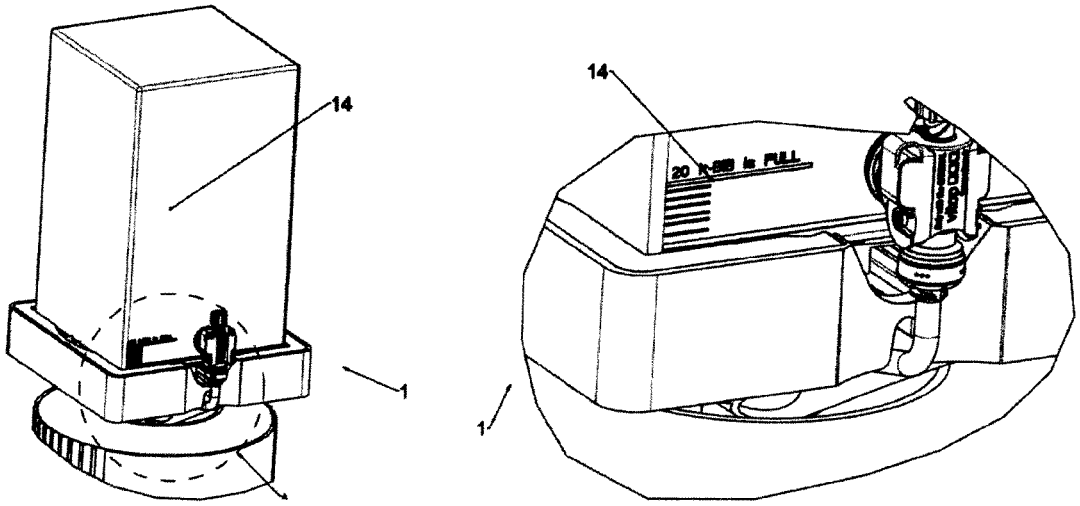
FIG. 22 is a sectional view of kit of FIG. 16 with perspective and detailed view of the system with balance when the BIB is empty and the calibrated metallic spring is not compressed and signals to the user the need of changing a BIB according to references externally created on the BIB box.
Figure 23:
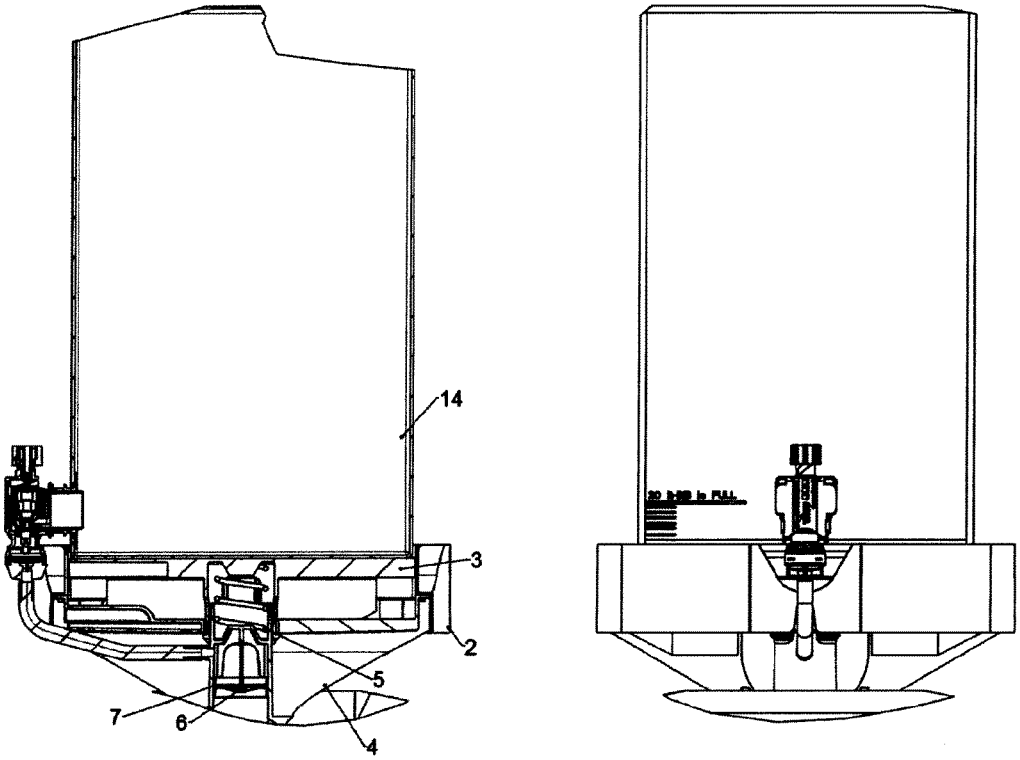
FIG. 23 is a front and side sectional view of kit of FIG. 16 to point out what happens when the BIB is empty of liquid and the optional system with balance is not compressed any more.
Figure 24:
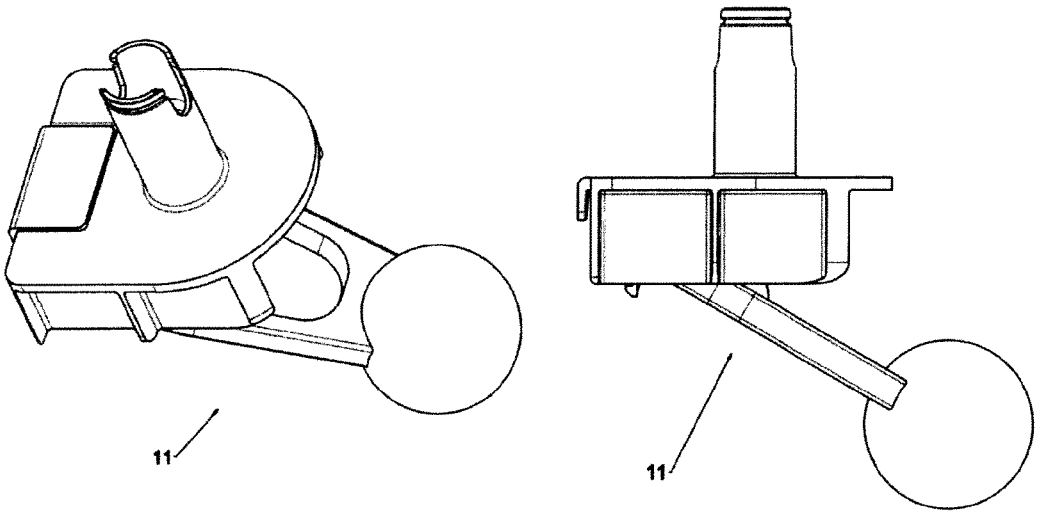
FIG. 24 is a perspective and side view of the floating system.

As can be seen below, it will anyway be necessary to have references also on the box of the BIB 14, in order to understand how much the BIB 14 itself has emptied, as shown in FIG. 20 and in FIG. 22. Rib geometries 4.6 adapted to keep in position the aesthetic cover 2 and to compensate its possible distortions from molding will be placed on the external walls of the kit 1. The guided seat 4.3 of the calibrated spring 5 with guiding and containing walls 4.4 of the same spring 5 will be placed on the upper central part of the body 4.

The main body 4, summarizing, is a seat for the supporting accessories of the BIB 14 and of their connecting and sealing elements with the water dispenser 12.

On the central part of the body 4, a small connecting tube 4.1 is laterally placed (but, as can be seen below, by changing the geometry it is possible to create, as for the body 17, a central axial connection 17.1), adapted to connect the flexible hose 9 (discriminating element between Model 1 and Model 2) (which in turn will be connected to the connector 10 for the plug), preferably made of silicone of the foodstuff type, whose function is connecting the BIB 14 to the system or kit 1 which will be connected to the water dispenser 12. Inside the lower part of kit Model 1, ribs 4.2 will be placed, adapted to keep the check valve system 6, preferably with umbrella type (FIG. 31 and FIG. 32) in the right position at height level with respect to the connecting tube 4.1. The lower external part of kit Model 1 will have the main feature of getting back completely the geometry of rigid water crocks in order to provide the chance of placing standard marketed plugs 8 for water crocks (of the "valve lock" Bericap type, not shown) and consequently in order to be able to be connected to the majority of existing water dispenser systems 12.

Figure 16:
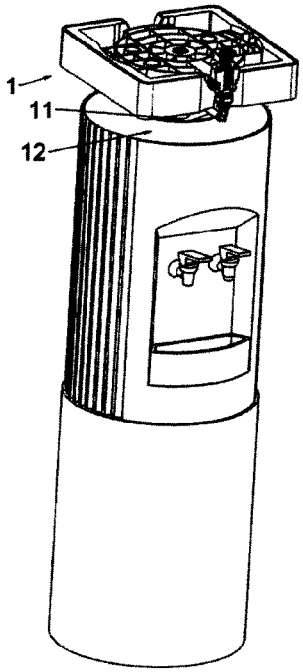
FIG. 16 is a perspective view of kit of FIG. 7 on an existing generic water dispenser.
Figure 17:
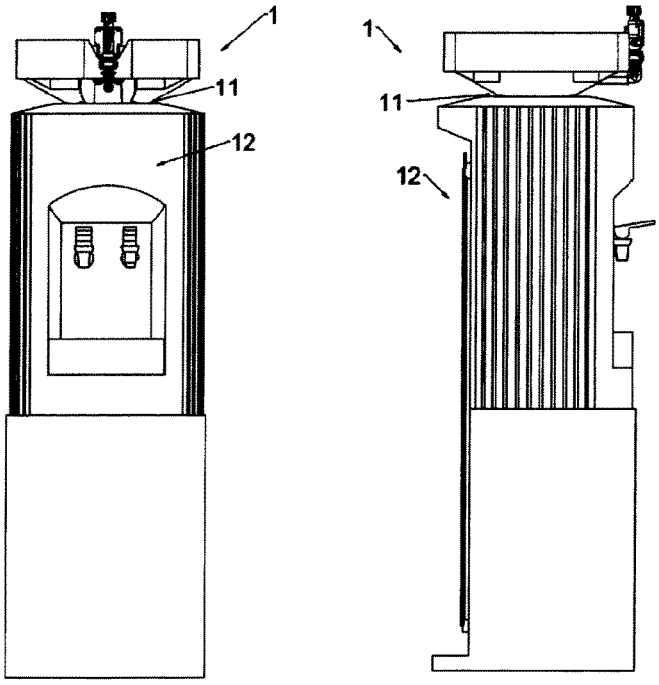
FIG. 17 is a front and side view of kit of FIG. 16.
Figure 56:
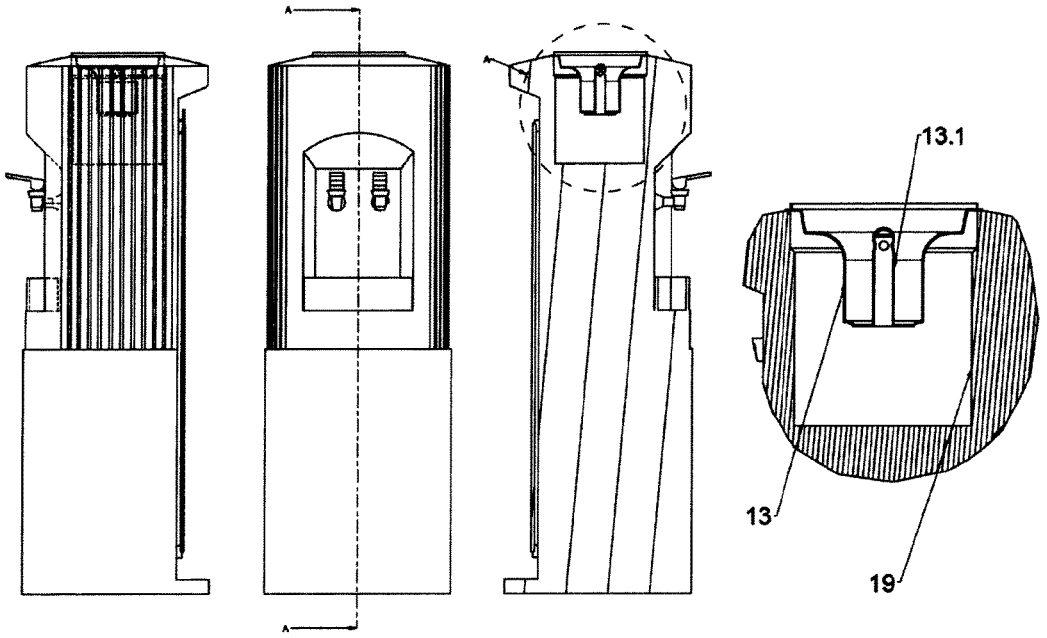
FIG. 56 is the side, front, side sectional and detailed view of the water dispenser for Closed Systems with sealing cone and venting hole (usually obtained on the cone itself and not shown) with check valve and filter (not shown)
Figure 57:
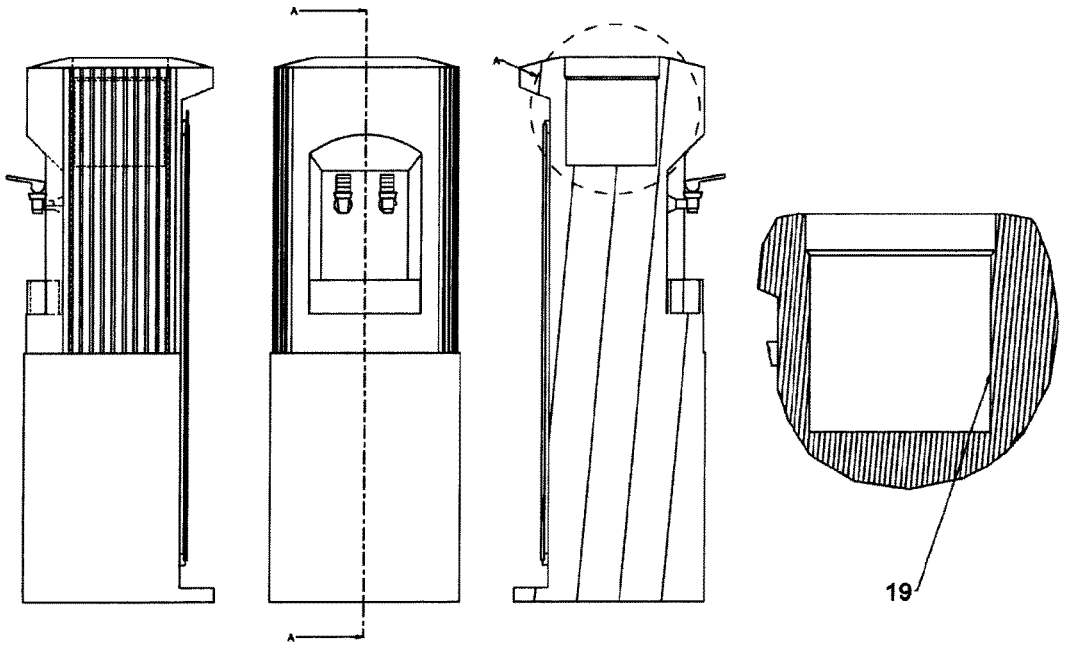
FIG. 57 is the side, front, side sectional and detailed view of the water dispenser for Open Systems without sealing cone and with a tank only.

The plugs 8 of the "valve lock" type provide the chance of directly connecting to the most modern water dispensers 12 manufactured and equipped with systems with PIN 13 shown in FIG. 16 and in FIG. 15 and of check valve 6 for air entry with filter (not shown) for SC (FIG. 56). For the other systems, namely the open ones of SA type (FIG. 57) (with and without PIN 13, since also a water dispenser equipped with PIN system 13 but without check valve on the air hole (which is always present on water dispensers since they have been designed to operate with rigid water crocks) is also deemed as Open System, and in this case the seat for the Open Systems will have to be created, removing from the water dispenser 12 the part PIN 13), there will be two possibilities, namely add to the kit 1 with lower part shaped as carafe neck and plug 8 the additional floating device 11, or change the profile of the lower part of the main body, obtaining the seat for inserting the flexible plastic ring 15 which will perform an operating seal on the side walls of the water dispenser 12 (FIG. 57). Differently from the floating device 11 for Open Systems SA which can be used both for Model 1, and for Model 2 (which in any case finds and keeps the system open), the change of the lower area of kit 1 useful to receive the OR-ring 15 which will perform a direct seal on the tank 19 of the water dispenser 12, will transform it from SA to sealed and pressurized SC.

It must further be remembered that the sealing and connecting system of the kit 1 will be connected to the BIBs 14 by means of a flexible hose 9, to a connector 10, which can be for example among those described in WO-A1-2012176221, or WO-A1-2007052316, or EP-A1-1627850, all in the name of the Applicant of the present invention.

As previously stated, in the seat 4.3 the calibrated spring 6 will be placed (depending on the specific weight of liquid contained in the BIB 14) whose purpose is moving the plate 3 and giving the chance of seeing whether the BIB 14 is still full of liquid or to be exchanged. The plate 3 will be operatively connected to the main body 4 by means of flexible tooth obtained on a central cylinder 3.1 with recessed geometries (to be able to provide the right flexibility to the cylinder itself) and anchored to the body 4 (4.14) by means of small tooth geometries (3.2) obtained on the extreme part of the cylinder 3.1, adapted to block the plate 3 itself when the spring 5, which is in the seat 4.3 obtained on the body 4 and the seat 3.5 obtained on the plate 3, reaches a prefixed position. The plate 3 will further be vertically guided by the hole geometries 3.3 obtained on the plate 3 and cooperating with the cones 4.9 obtained on the main body 4.

Moreover, in order to increase still more the guided system of the plate 3 and therefore have a "descent" and a "rise" of the same (depending on its weight and therefore on the contents of the BIB 14), there will be geometries with external guide 3.4 obtained on the plate 3, which will cooperate with the rib geometries 4.12 present on the body 4.

Externally, and anchored to the main body 4, the cover 2 will be placed, whose purpose is mainly aesthetic. Unloading geometries 2.1 (in an opposite position one with respect to the other) will be obtained thereon, which, once placed on the main body 4, will be placed on the similar geometries 4.5. Teeth-shaped fastening geometries 2.2 will also be present on the cover 2, which will be fastened to the external edge of the main body 4.11.

Figure 31:
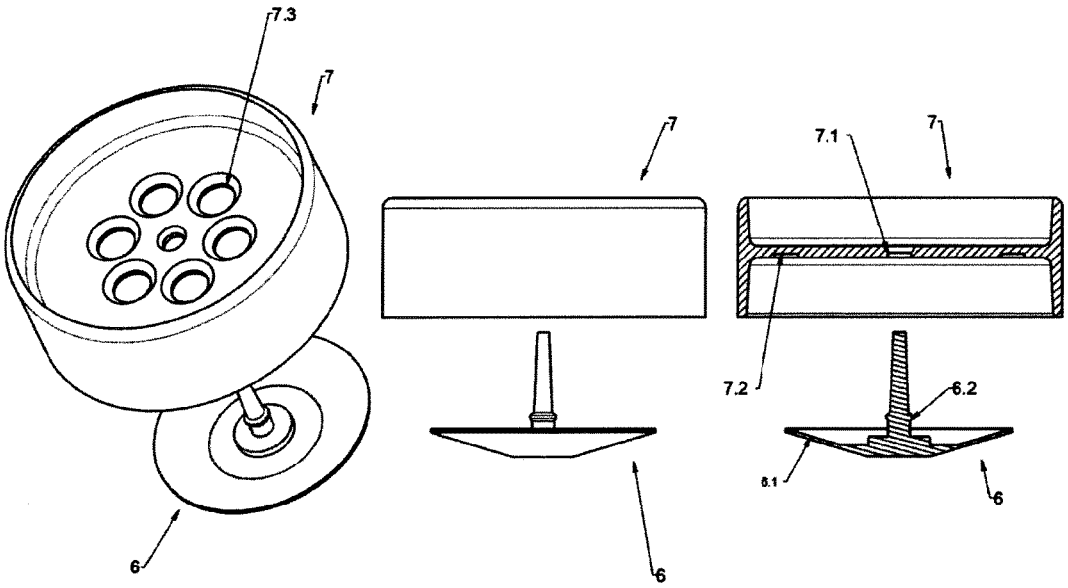
FIG. 31 is the exploded perspective, side and sectional view of the system with umbrella valve present on kits Model 1.
Figure 32:
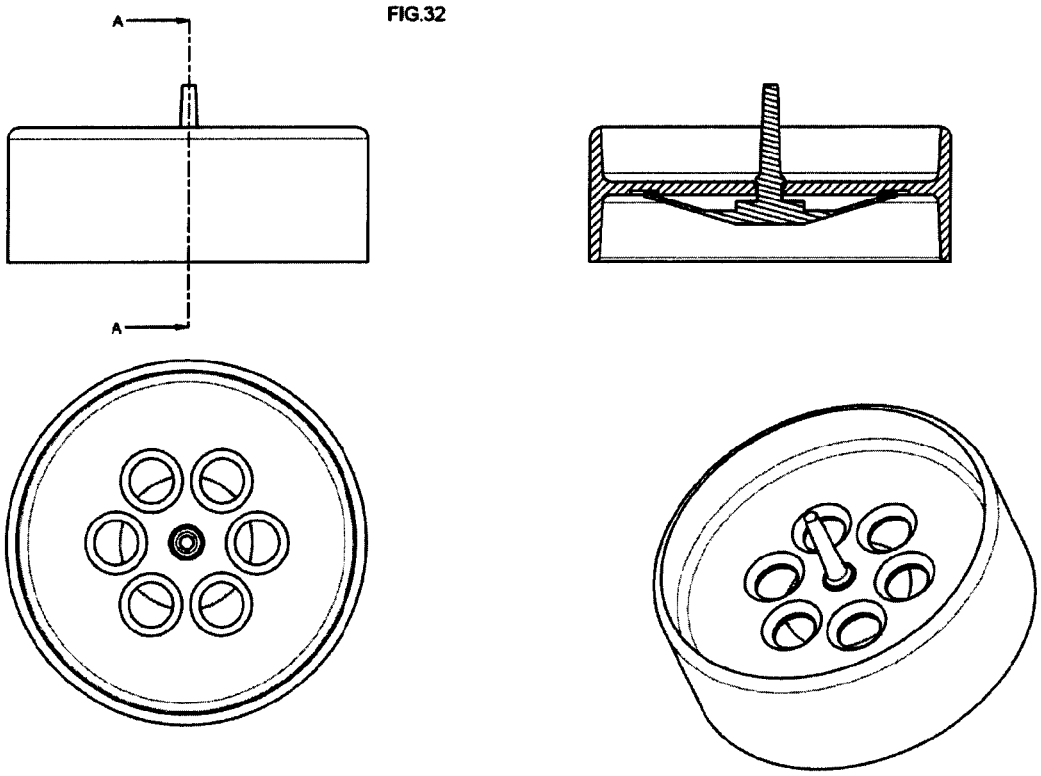
FIG. 32 is the assembled perspective, side, sectional and upper view of the system with umbrella valve present on kits Model 1.
Figure 33:
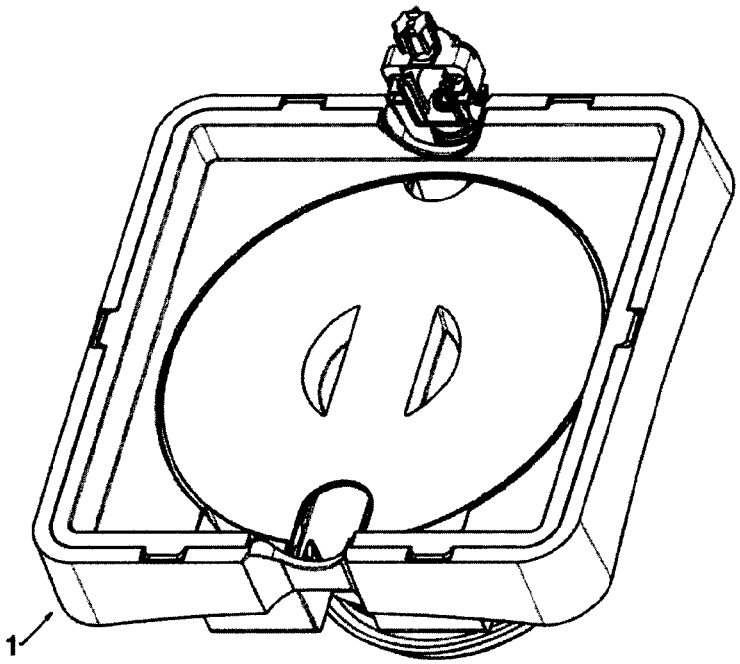
FIG. 33 is a perspective view of an embodiment of kit Model 2 for Open Systems.

The internal part of the body Model 1 will be equipped with a system with umbrella-type check valve 6 and valve support 7, which will be fastened to the main body 4 (but such system can be replaced by any check valve system which, even if not shown, is part of the invention), as shown in FIG. 31 and in FIG. 32.

Purpose of such system, above all when the Model 1 will be equipped with a plug 8 of the "valve lock" type and water dispenser with air-tight connecting PIN 13, is avoiding that, in the closed system created when disconnecting the BIB 14 when, for example, it will have to be change or due to any other reason which generate a temporary disconnection of the connector from the delivering tap of the BIB 14, the pressure created inside the system with water dispenser 12+kit Model 1 for SC goes back and anticipates the closure of the safety plug 8 of the connector itself and generates a slight leakage of liquid.

Figure 6:
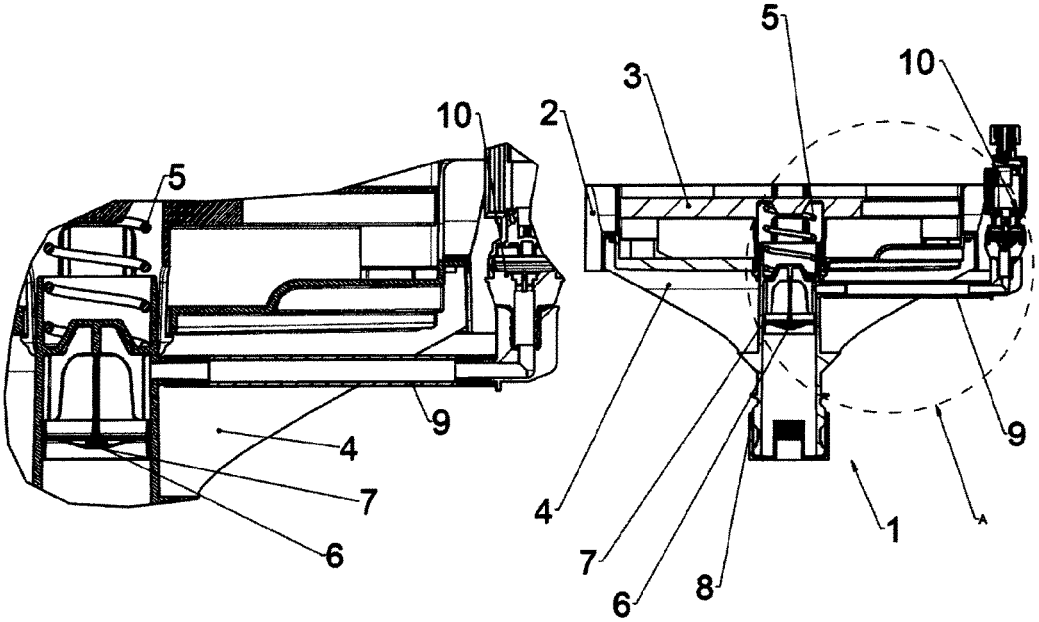
FIG. 6 is a side sectional view of kit of FIG. 1 and a detailed view of the optional connecting system and of the optional system with balance with metallic spring.
Figure 7:
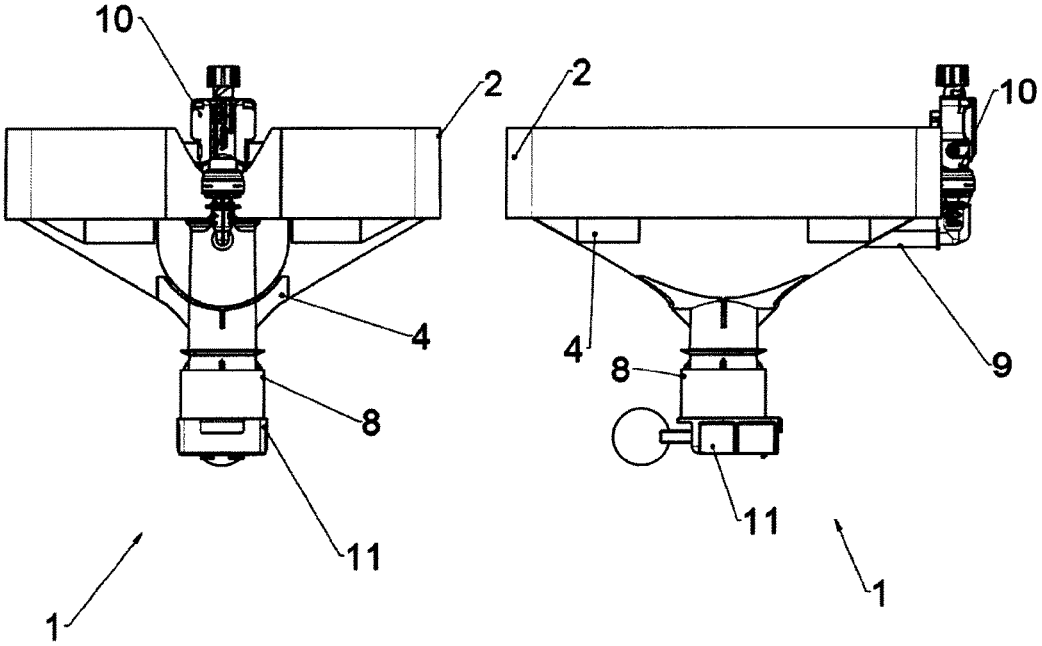
FIG. 7 is a side and front view of kit Model 1 for Open Systems having inserted the floating system of FIG. 1.
Figure 8:
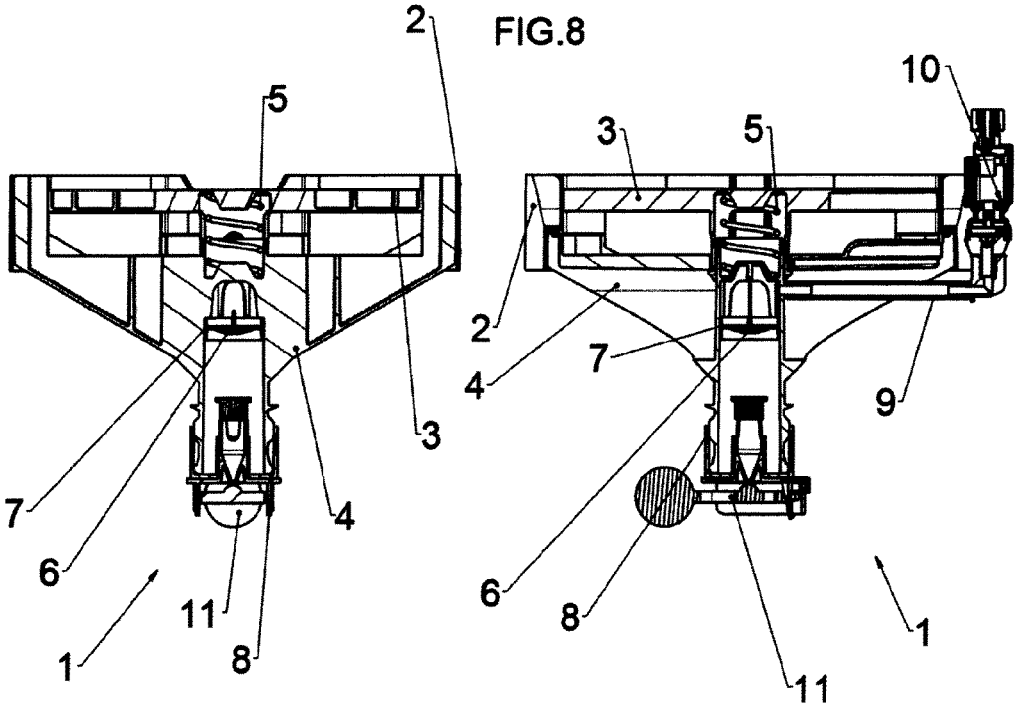
FIG. 8 is a sectional view of kit of FIG. 7.
Figure 9:
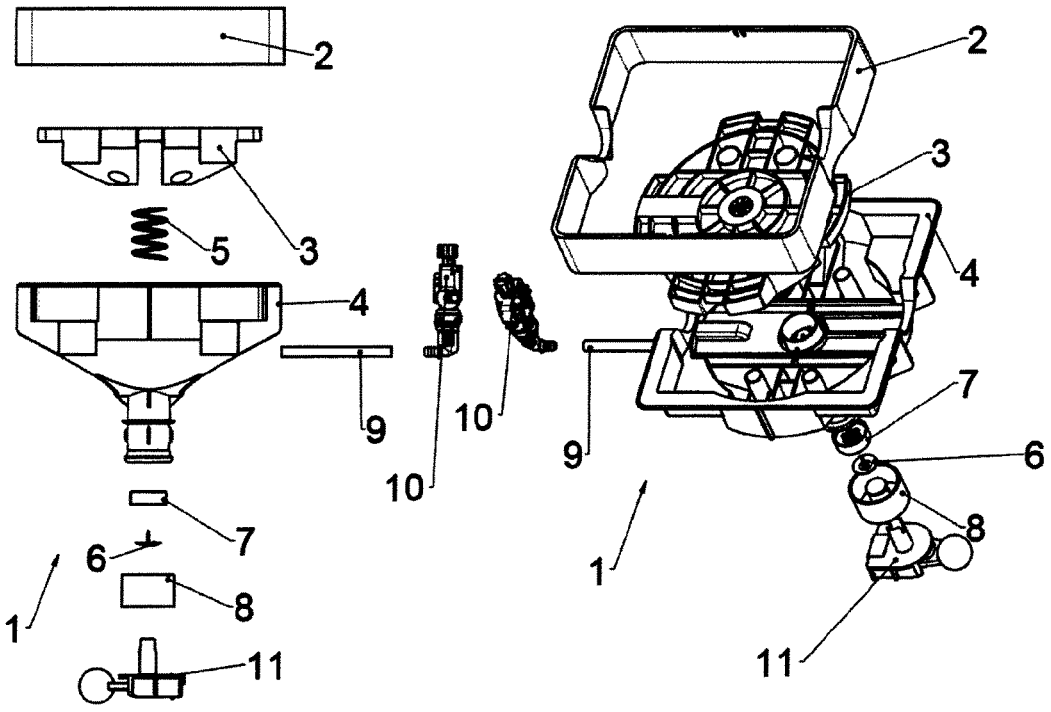
FIG. 9 is a exploded view of kit of FIG. 7.
Figure 10:
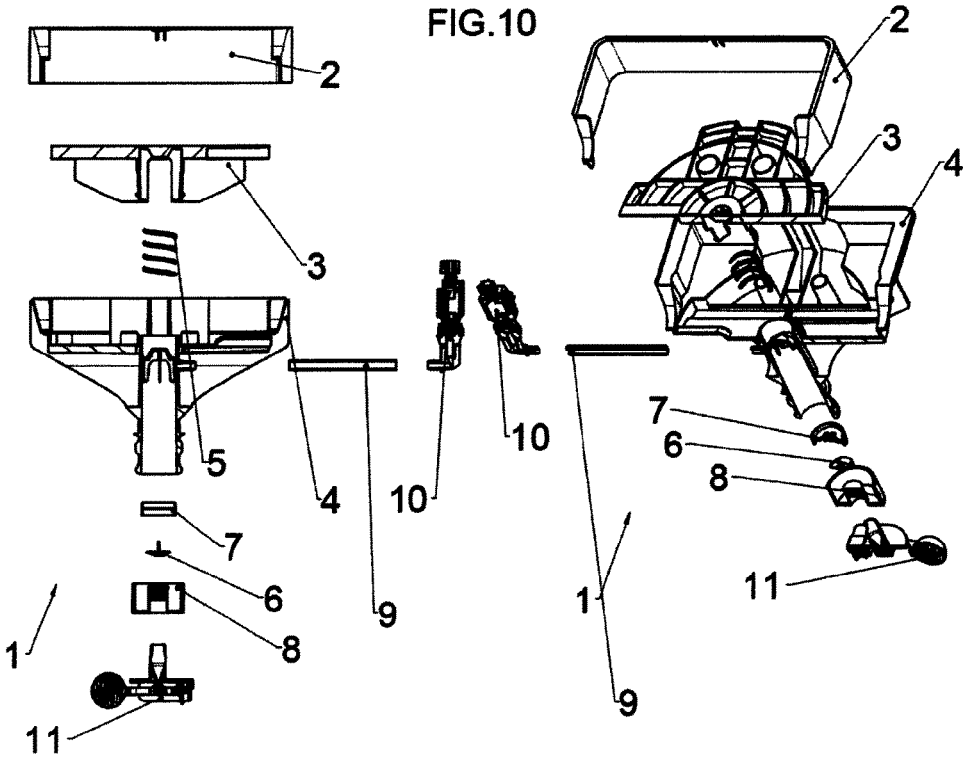
FIG. 10 is a exploded sectional view of kit of FIG. 7.
Figure 11:
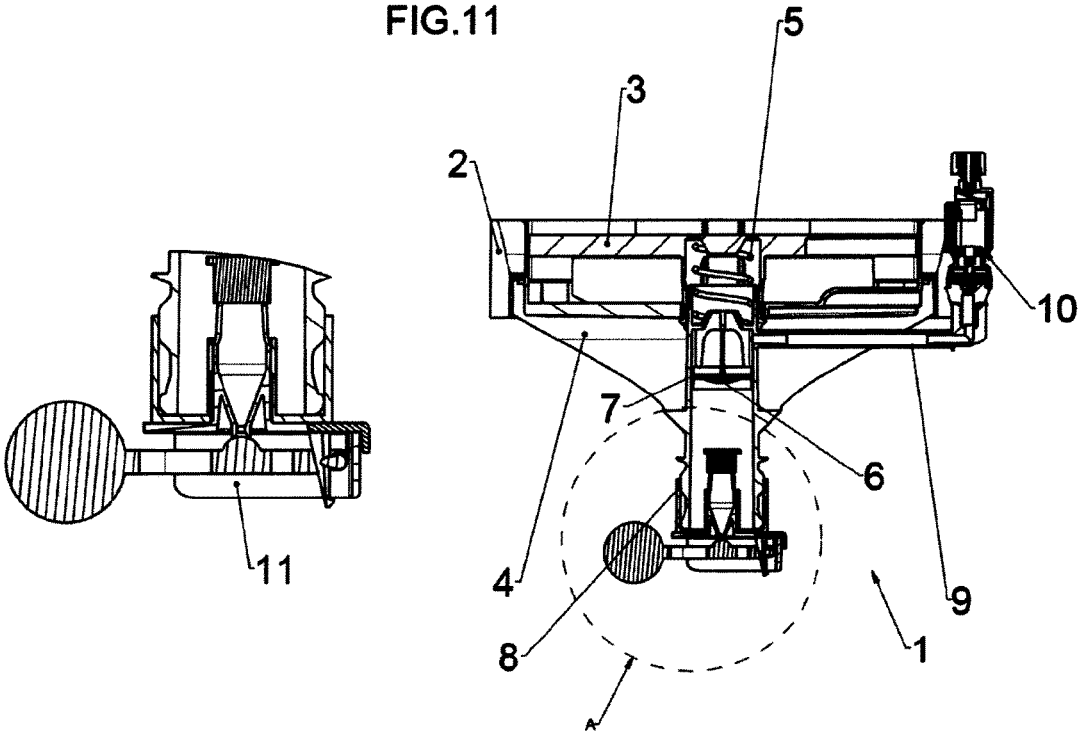
FIG. 11 is a side sectional view of kit of FIG. 7 inserted in the kit plug and a detailed view of the optional floating system.
Figure 12:
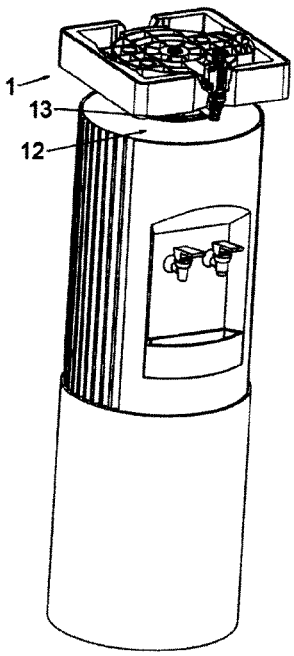
FIG. 12 is the perspective view of kit of FIG. 1 on a generic existing dispenser.
Figure 13:
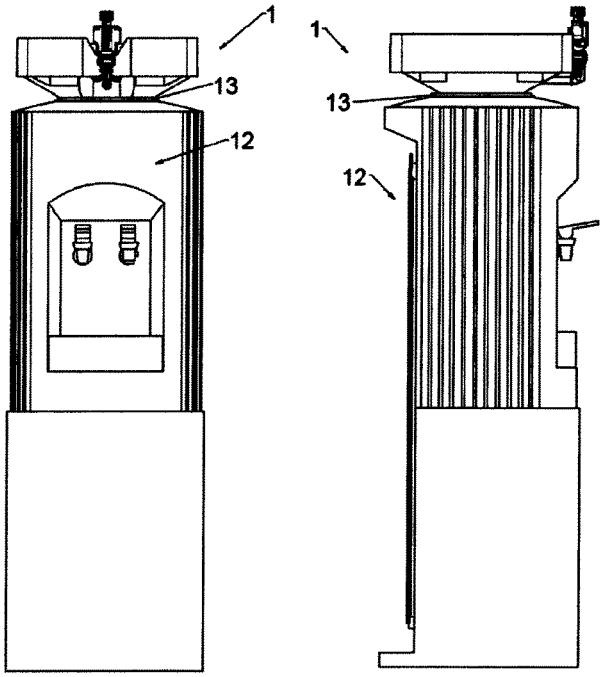
FIG. 13 is a front and side view of kit of FIG. 1 on a generic water dispenser.

In fact, upon every liquid delivery, it will be sure that the check valve 6 (in this case with the flexible umbrella-type geometry) fastened by engagement to its seat 7 in the central fastening point 7.1 equipped with holes for the passage of liquid 7.3, seals between the small lip of the valve 6.1 and its seat obtained on the valve-carrier 7.2 every time the delivery from the water dispenser 12 ends and the system returns perfectly closed SC. FIG. 32 shows the assembled check vale system, while FIG. 6 shows its assembling in the main body 4.

Therefore, summarizing and with reference to FIGS. 1 to 6, as regards kit Model 1 for Closed Systems for water dispensers 12 equipped with PIN 13 for a direct connection with a plug 8 of the Bericap type and check valve 6 with air filter (not shown and anyway present on the water dispenser), it is formed of an external cover 2 fastened by means of small teeth 2.2 obtained thereon and fastened to the external edge 4.11 obtained on the upper part of the main body 4.

In turn, on the main body 4, in a suitable seat 4.3, a calibrated spring 5 will be centrally placed, and, above it, in the suitable seat 3.5 obtained, the plate 3 will be placed, which in turn will be fastened to the main body 4, in the suitable through-seats 4.14 obtained, by means of the small teeth 3.2 obtained on the central flexible cylinder 3.1 of the plate 3.

This system is optional, and therefore has to be considered as additional system.

The balance system allows the user to understand the exact moment for changing the BIB 14 which, otherwise, since it is not a transparent water crock, would be impossible to understand, since there is a decorated cardboard box as external element of the BIB vessel 14.

The mechanical system with calibrated spring 5 as balance can also be used, for a better accuracy, together with a graduated scale obtained on the external box of the BIB 14, as shown in FIGS. 20 to 23. The more the weight of the BIB 14 decreases, the more the spring 5 rises the plate 3, and the more the graduated scale approaches the limit which points out the need of exchanging the BIB 14.

Obviously, this system can also be transformed from mechanical (with calibrated spring 5) to electronic (with load cell or various types of sensors, not shown) always connected to the weight of the BIB 14 and always remaining within the invention. Such systems fall within the invention even if not shown, since they can be easily made.

Passing to the lower part of kit Model 1 for SC, it can be noted in detail (FIG. 2) the connection by means of a flexible hose 9 between the connector 10, which remains the single element which will be able to connect the delivering tap existing on the BIB 14, to other external elements and the lateral tube 4.1.

The system 6, 7 with umbrella-type check valve (or other valves, not shown) will be placed inside the main body 4.

Finally, the last element to be connected is the plug 8.

This is also the reason why the bottle neck geometry has been faithfully reproduced, to be able to adapt the standard plug 8 already present on the market, already known by all customers and already capable of being adapted to every SC.

As can be seen in FIG. 14 (in detail), the plug 8 will be operatively connected to the PIN 13 making a seal and creating (also due to the check valve present on the water dispenser 12, not shown in the drawings) a closed system SC.

If instead there is a water dispenser 12 with PIN system 13 but without check valve on the air inlet hole or, even for older dispensers, systems with tanks (FIG. 57) without the PIN 13 as also shown in FIGS. 18 and 19, it will be necessary to add to the Kit Model 1 for SC a closing system driven by a floating element 11, which, driven by the liquid level which can be found inside the tank, upon arriving at a certain level, will close the liquid outlet hole, thereby preventing it from going out of the water dispenser 12.

The additional module with floating valve 11 is connected to the kit Model 1 by means of the plug 8, since its upper part is the same as the standard geometries of the PIN 13 with elongated body.

The kit 1 in turn will be connected to a system with BIB 14 (always subjected to atmospheric pressure) by means of the connector 10.

The system being created (kit 1+water dispenser 12), differently from rigid water crocks (which de facto do not feel any difference between water dispensers with or without check valve on the air hole since they comply with the Pascal principle, namely a water crock full of liquid (water in this case) completely overturned on a tank full of liquid (water in this case) (or which anyway will be filled with liquid if this is a first use) will receive a pressure transmitted by the one received by the tank liquid (atmospheric pressure) which will also be transmitted to water which is at the bottle mouth, pushing it upwards: consequently, water which is in the bottle cannot go out), if the water dispenser is not equipped in its air entry hole with a check valve, at a certain time from such hole liquid contained in the bag of the BIB 14 (which has the liquid always pushed by the atmospheric pressure) will go out.

Figure 25:
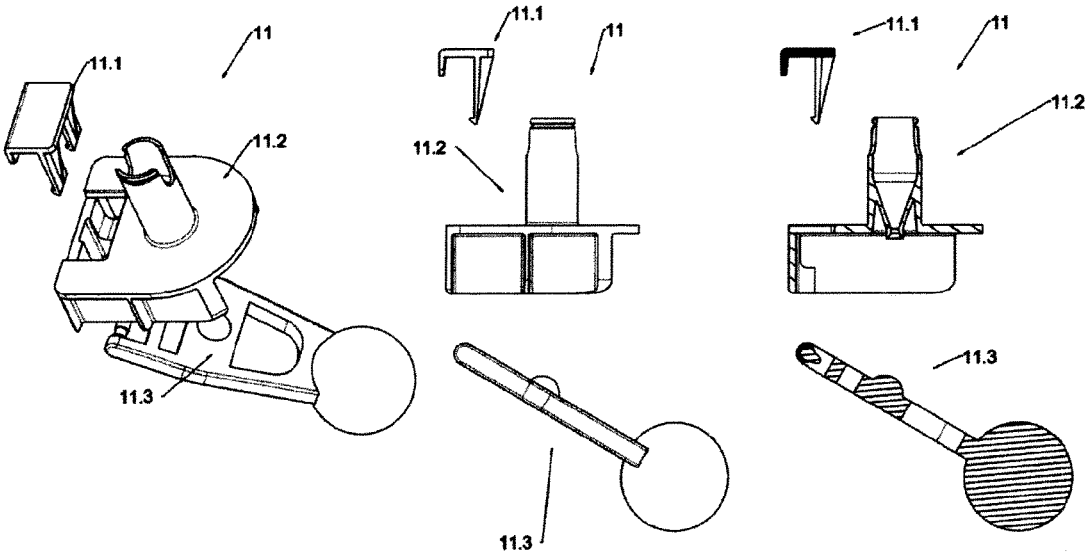
FIG. 25 is a perspective side and side sectional view of the exploded view of the system of FIG. 24.

With reference to FIG. 25, it can be noted that the floating valve module 11 is composed of a main connecting body 11.2, a floating arm 11.3 and possibly blocking/creating means 11.1 of the hinge on which the floating arm 11.3 will rotate.

FIG. 26 shows the assembled floating module 11 in its open position.

The sealing valve 11.3.1 and the floater 11.3.2 will be directly obtained (from molding) or afterwards assembled (assembling) on the floating arm.

The sealing area of the floating arm 11.3.1 will perform an operatively seal when it is in a closing position with the cone/cylinder 11.1.2.

As can be noted, the floating mass has been voluntarily offset, which is the one that in the end provides the necessary force to be able to close the liquid passage when the floating module 11 is in its closing position (FIG. 27).

In this case, the liquid will exert on the floater such a force that, acting from bottom to top (namely the filling direction of the tank 19 when there is a SA without PIN 13), will make the arm 11.3.1 rotate, considering the constraint in 11.3.3 (FIG. 26), and, once having reached the closing position, it keep the same due to the force (moment) amplification given by the produce of the force acting on the floater for the arm 11.3.1, namely the distance between floater and axis of the sealing area of the floating arm 11.3.1.

Moreover, in order to make this operation easier, it has been thought of shaping the inside of body 11.2 in its area 11.1.2 (FIG. 26) in order to have the so-called Venturi effect.

Everything because from the BIB 14 placed above the kit Model 1 for SA, a high pressure is made arrive to the floating system 11.

Such pressure would not allow the system with floating valve 11 to remain closed, since the pressure coming from the BIB 14 (above all when it is full) would efficiently and finally contrast the moment force created by the floater 11.

Therefore, the channel has had to be shaped so that the pressure decreases (and consequently the liquid speed increases) creating a bottleneck 11.1.2.

Having a lower output pressure from the system or kit 1, the floater of the floating system 11 has been made in order to have such a force as to close the liquid outlet channel.

It can be though that the pressure increases next to the bottlenecks 11.1.2; however, due to the lift law, next to the bottleneck 11.1.2, is the speed that increases.

The floating system 11 will be quickly placed on the kit Model 1 by inserting it in its operating seal (it will have the same sizes of the standard PIN of the water dispensers) with the plug 8 by means of the calibrated cylindrical wall 11.1.4.

Figure 34:
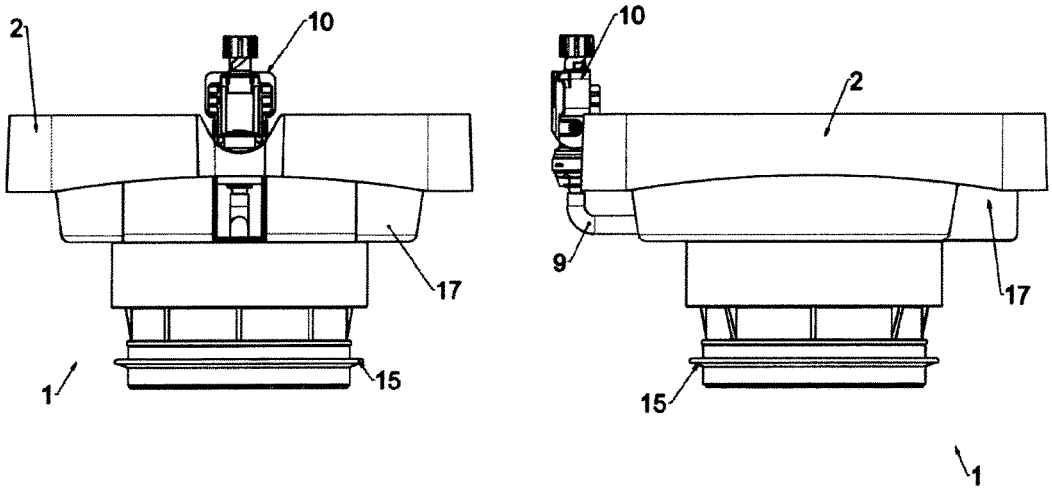
FIG. 34 is a side and front view of kit of FIG. 33.

There is a second chance of placing the kit Model 1 on Open Systems: it will be modifying the lower part of the body 4 with a geometry adapted to receive the OR-ring 15 as shown for the Model 2 in FIG. 34 (but not shown in this application for Model 1). In this case, the kit Model 1 will perform a direct seal by means of the gasket 15 on the vertical walls of the tank 19 (FIG. 57) transforming the open system into a sealed closed system.

The kit Model 2 will now be described in its different arrangements.

First of all, such kit will be described for the direct connection with Open Systems (FIG. 57).

In this case, this kit is used when there are water dispensers 12 with open system (FIG. 57) or not equipped with check valve on the air entry hole of the water dispenser 12 (it must again be remembered that, for the system with BIB 14 it is not necessary, differently from rigid water crocks, to have the air entry to operate. The problem for the system with BIB 14 is that all water dispensers 12 have the venting holes which, if not protected by check valves, become a possible leakage area for the kit 1 which always operates under atmospheric pressure. Thereby, there is the need of having different versions of the kit 1.).

In this case, by using kit Model 2 (shown in FIGS. 33 to 41), a water dispenser 12 is transformed from open system into sealed closed system.

On this kit, by exploiting the fact that, differently from Model 1, it has the connection of the flexible hose 9 in a central axial position 17.1 and 18.1 (according to the version), it has been tried to exploit the advantage (at mold level) of having all geometries in axis to compact ad optimize all accessories which necessarily must be present and above all are common to the two Models.

With reference to FIG. 41, the kit Model 2 for SA (FIG. 57) is composed of a main body 17 on which all necessary geometries are obtained for the operation or anyway the assembling of all components useful for its operation.

In this case, the main features of this Model 2 will be dealt with, neglecting the common points and geometries (already wholly described before).

First of all, in order to simplify the piece at molding level and thereby at mold level, it has been thought to model the piece so that, differently from the kit Model 1, the small connecting tube 17.1 (FIG. 41) which will be the element of the main body 17 which will allow connecting the water dispenser 12 with the BIB 14 which is on the kit 1 by means of a flexible hose 9 made of silicone and a connector 10 which will then be operatively connected to the delivering tap present on the BIB 14, the connecting tube 17.1 will be in an axial-vertical position on the main body 17.

This will allow simplifying some geometries, such as for example creating the valve-carrier geometry 17.6 directly on the main body 17 and then, differently from Model 1, removing the valve-carrier piece, instead necessary if there is the small connecting tube 4.1 placed in a lateral position (injection mold needs).

Below the tube 17.1, as can be seen in FIG. 41, necessary geometries 17.6 will be obtained (integrated in the piece) for fastening the valve 6, preferably of the umbrella type.

Below the umbrella valve 6 (fastened to the main body 17), there will be a cylinder 17.2 shaped so that the liquid always has a passage area and the umbrella valve 6 is free of correctly working.

This cylinder 17.2 will protect the valve 6 from possible members which could be found inside the tank 19 of the water dispenser 12 and that, without the laterally recessed cylinder geometry 17.2, would squash the umbrella valve 6 preventing it from correctly operate.

The shaped cylinder 17.1 has a useful height so that the sealing ring 15 manages to seal in the tank 19 of the water dispenser 12 without the possible pieces inside the water dispenser 12 impact on the shaped cylinder 17.1 before the gasket 15 operatively seals with the tank 19 of the water dispenser 12 itself.

Figure 35:
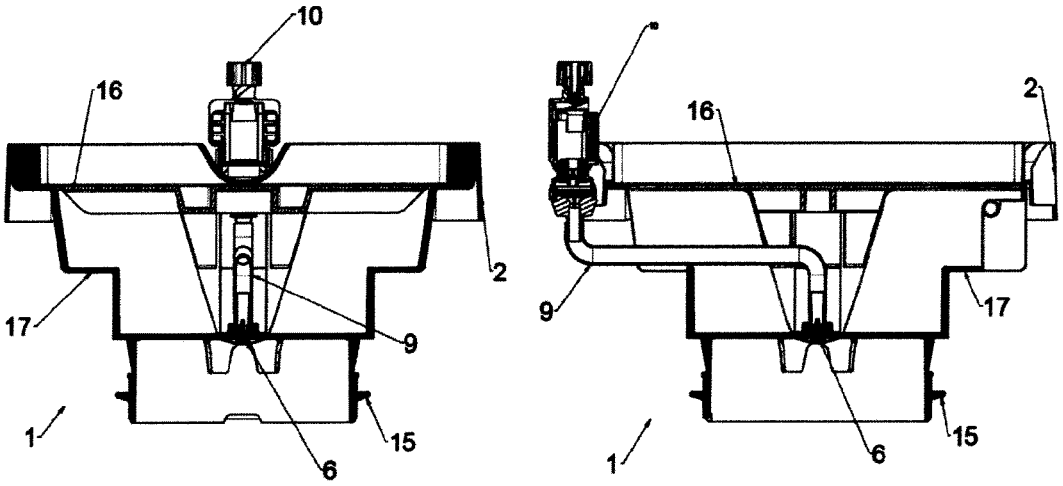
FIG. 35 is a sectional view of kit of FIG. 33.

Going downwards in the main body 17, externally one can see the geometries 17.3 (FIG. 41) adapted to block and contain the sealing ring 15 (FIG. 35).

The recess 17.4 obtained on the lowest part of the main body 17 will be sued to have an area to be able to remove the sealing ring 15, possibly for its maintenance or replacement.

Going back to the upper part of kit Model 2 and always with reference to FIG. 41, in its internal part where the stiffening geometries (ribs) have been obtained, the seat of the hinge 17.5 has also been obtained, where afterwards the plate 16 will be operatively engaged, which will allow its rotation by 90° and which this time will only have the function of cover of the connection area of the tube 17.1 and of support, by cooperating with the ribs of the main body 17.

Also for this Model, a mechanical or electric system can be created, to make a balance system like the previously described one.

Figure 42:
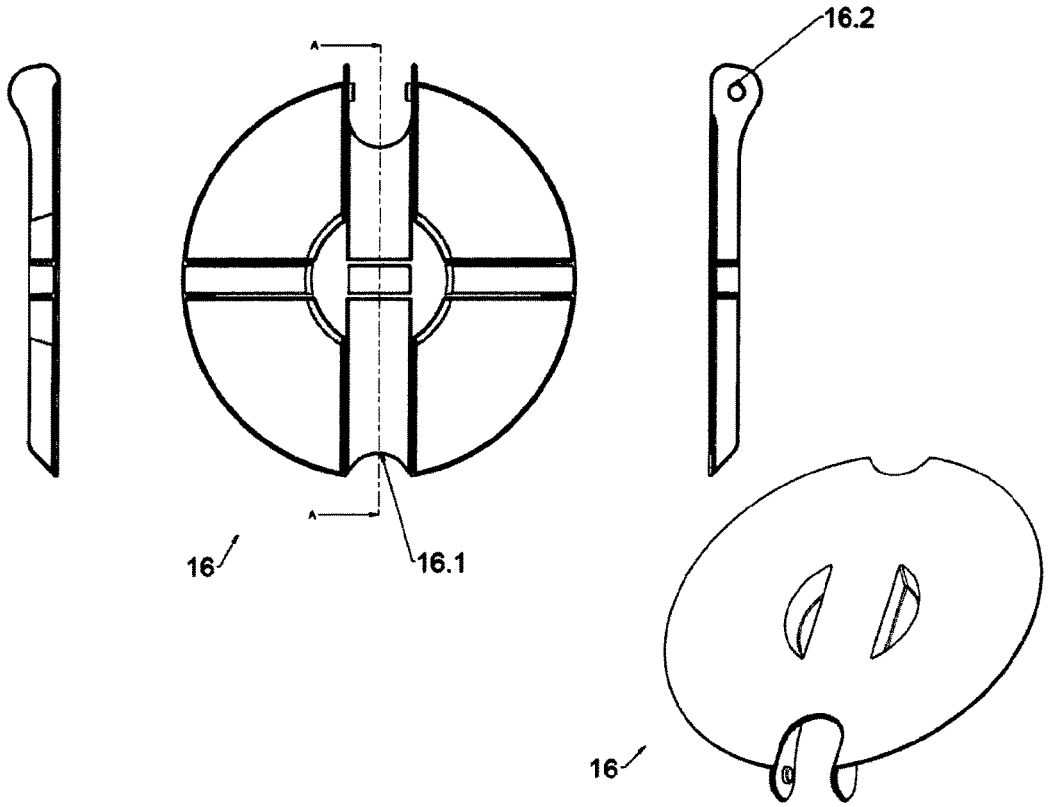
FIG. 42 is a perspective, side, front, upper and detailed view of the plate of kit Model 2.
Figure 43:
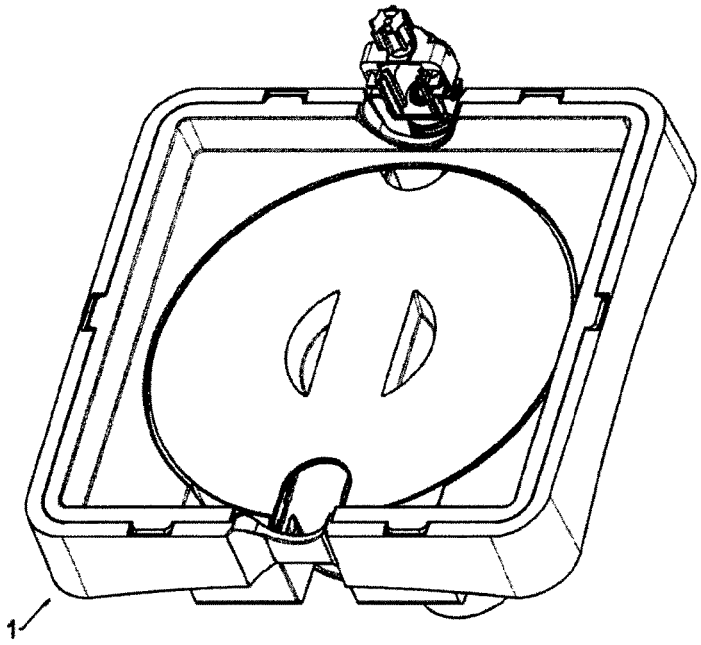
FIG. 43 is a perspective view of an embodiment of kit Model 2 for Closed Systems with neck profile for seat plug of the "valve lock" Bericap type.
Figure 44:
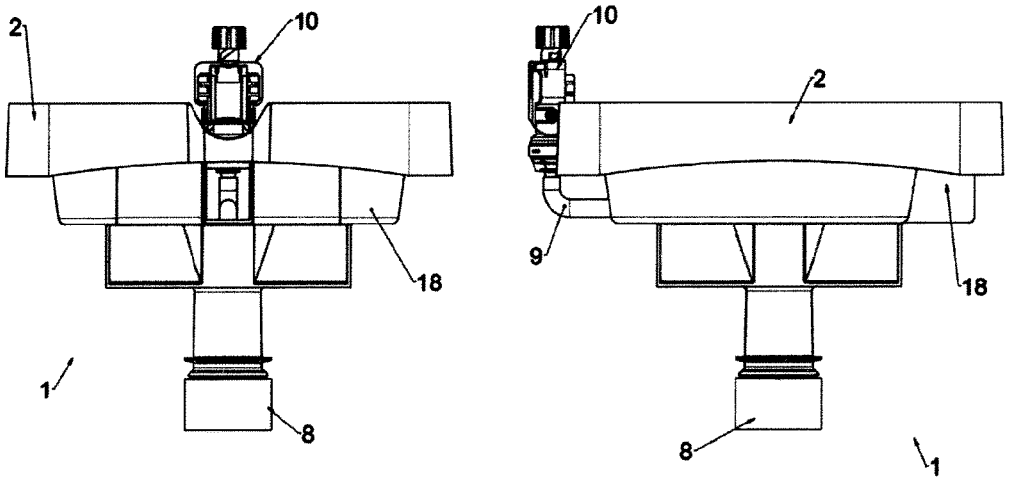
FIG. 44 is a side and front view of the kit of FIG. 43.

The plate 16 shown in FIG. 42 has rib-type stiffening geometries 16.3 which are also used as guide for the plate 16 when closing and opening, cooperating with the internal ribs of the main body 17.

The plate 16 will have hinge-type fastening elements 16.2 which will be operatively engaged with the geometries created on the ribs, or better holes, 17.5.

The plate 16 will have a recessed element 16.1 which allows having a catch area when the plate 16 will have to be opened, once constrained to the main body 17.

With reference to FIGS. 33 to 40, assembling, function and features of the system or kit Model 2 will be described, as assembled on a water dispenser 12 not equipped with PIN 13 (FIG. 14) or with PIN 13 but without check valve on the air hole of the water dispenser 12, and anyway in case of presence of a water dispenser 12 considered in general as an Open System (FIG. 57).

Figure 36:
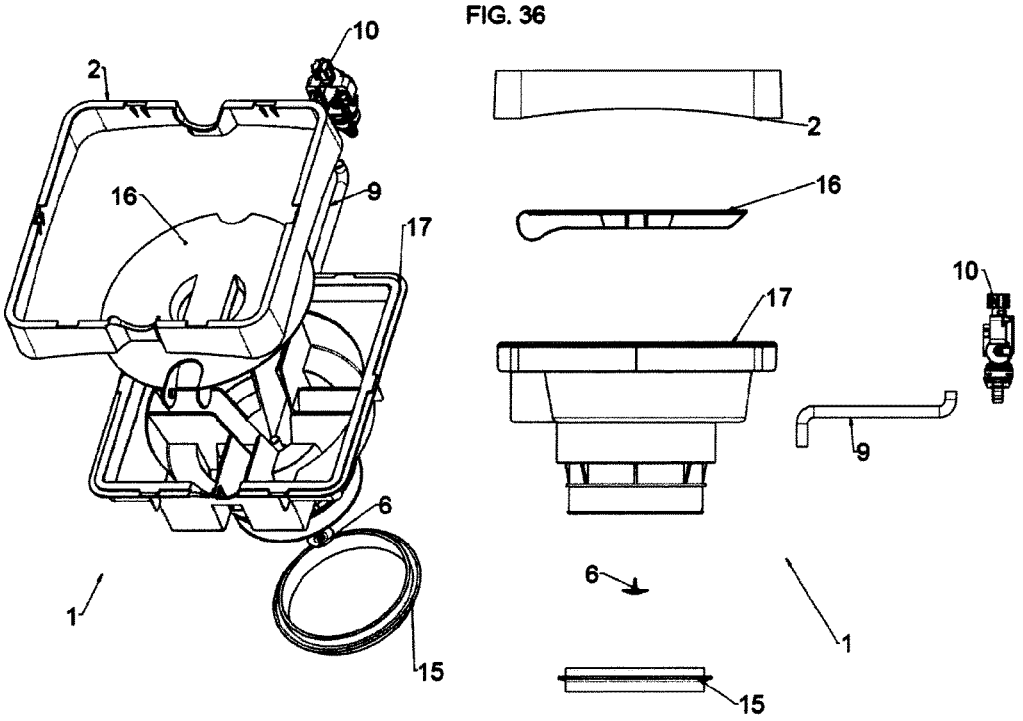
FIG. 36 is an exploded view of kit of FIG. 33.
Figure 37:
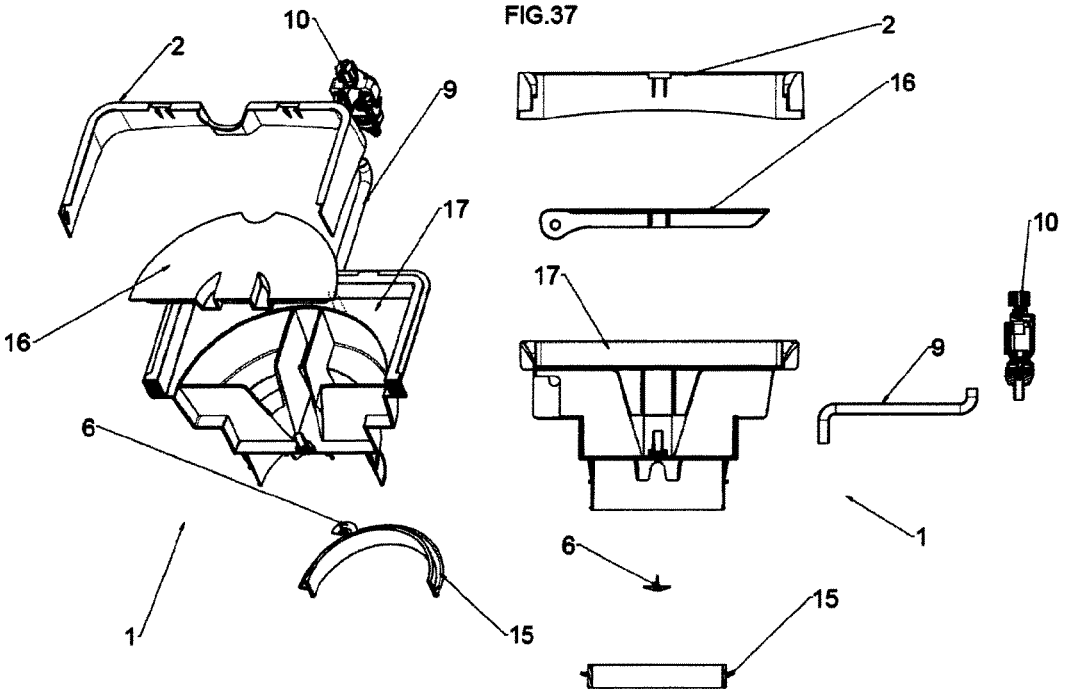
FIG. 37 is an exploded sectional view of kit of FIG. 33.
Figure 38:
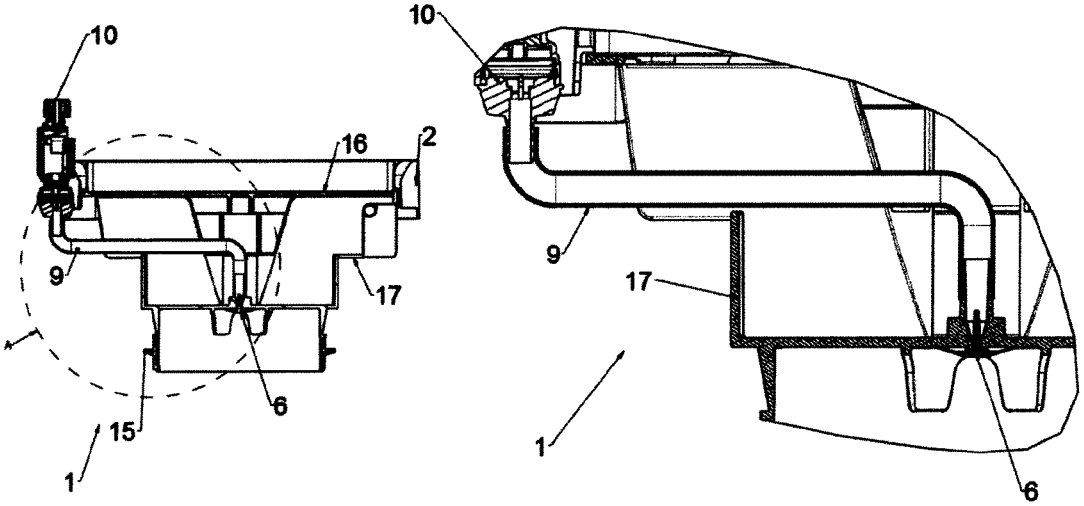
FIG. 38 is a side sectional view of kit of FIG. 33 and a detailed view of the connection system.
Figure 39:
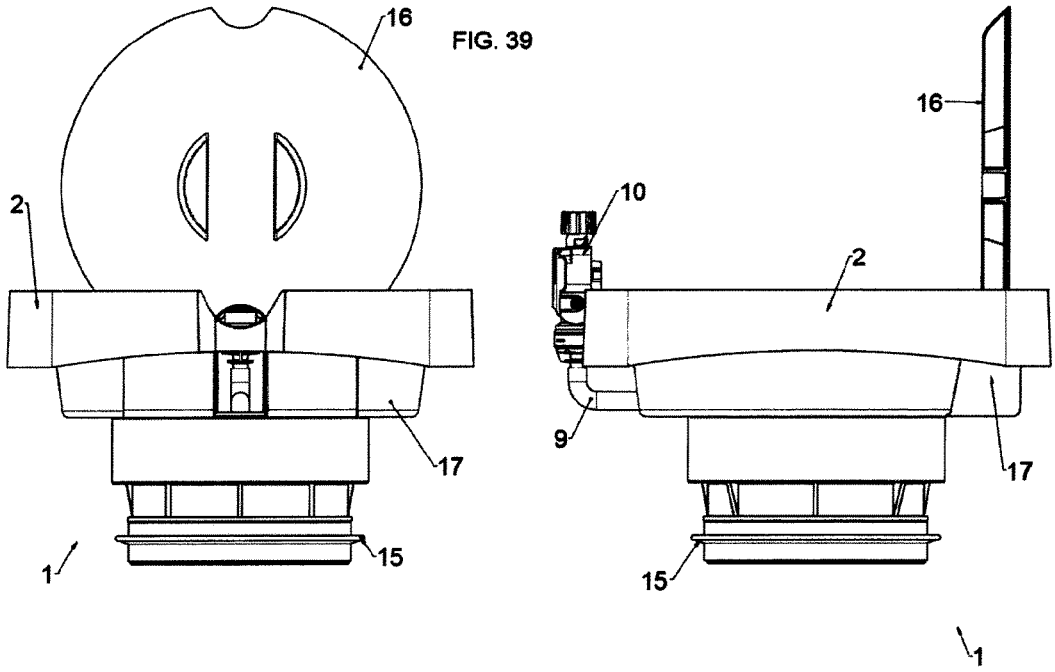
FIG. 39 is a side and read view of kit Model 2 with inspection plate in an open position for inspection.
Figure 40:
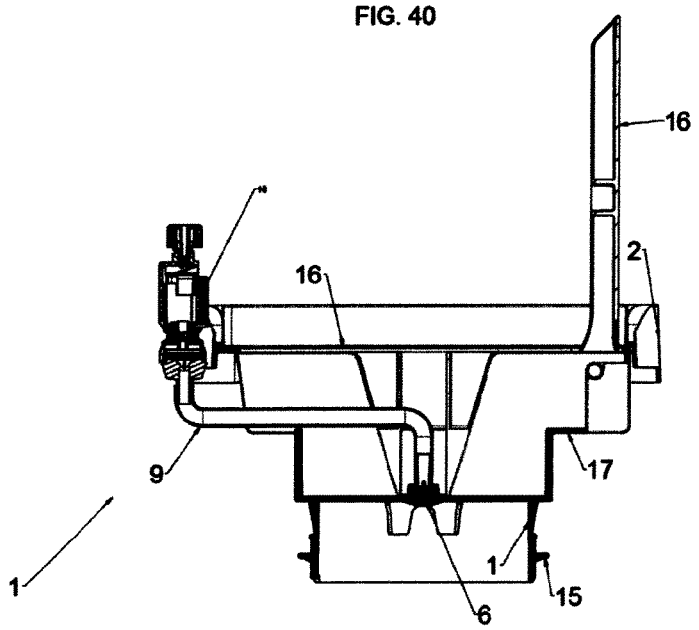
FIG. 40 is the sectional view of kit of FIG. 39 with inspection plate in an open position.

Taking into account FIG. 36, it can be noted that, on the main body 17, on which all basic geometries are obtained for the correct operation of kit Model 2, it will be assembled with engagement, exploiting the hole geometries 17.5 of the main body 17 and the projection geometries 16.2 of the plate 16, whose purpose is protecting and allowing a quick inspection of the parts affected by the connection between the main body 17.1 and the flexible hose 9, which will then be operatively connected to the connector 10 (which in turn will be operatively connected to the delivering tap present on the BIB 14).

Such plate 16 constrained on the main body 17 can be moved (through a rotation on the hinge created on the hole 17.5) till 90° with respect to the bearing plane of the BIB 14, freeing the area below the kit Model 2 for its inspection or cleaning.

Always on the main body 17, in its seat 17.6, the check valve 6 (in this case shown as an umbrella) will be operatively connected. Such valve 6 will be operatively coupled with the main body 17 and prevent the pressurized liquid (due to the above BIB 14) from anticipating the closure of the valve of the connector 10 making some liquid go out in case of disconnection of the BIB 14.

Under the umbrella valve 6, there is the recessed protecting cylindrical geometry 17.2, whose purpose is protecting and allowing the check valve 6 to be correctly opened and closed, without possibly having the problem that internal members of the water dispenser 12 prevent the normal opening and closing movement of the valve dictated by the internal pressures of the system with kit 1+water dispenser 12.

In the extreme lower part of kit Model 2 for Open Systems, there is the seat of the flexible gasket 15 which will perform an operating seal on the internal surface of the tank of the water dispenser 12.

The cover 2 is fastened to the main body of kit Model 2 and has the feature of being an interchangeable and possibly decorated aesthetic element of the system or kit 1.

Figure 45:
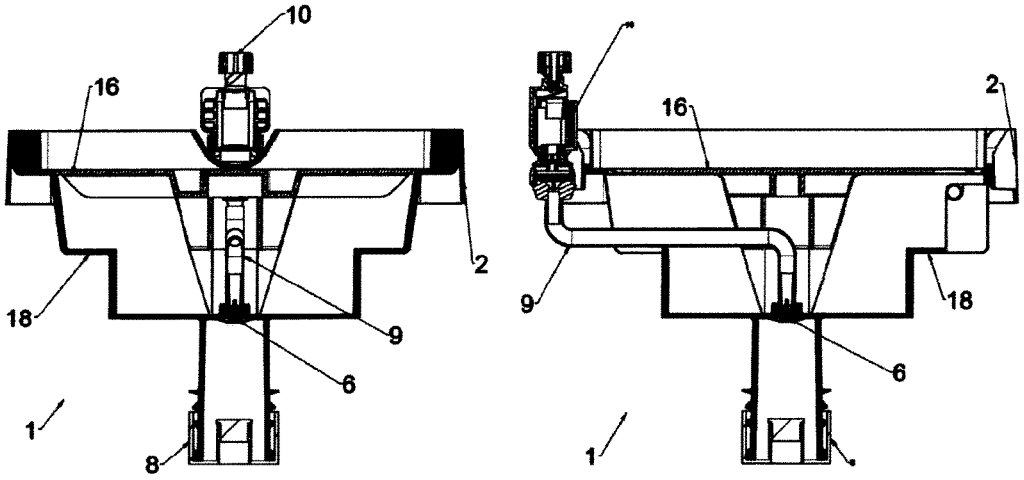
FIG. 45 is a sectional view of the kit of FIG. 43.
Figure 46:
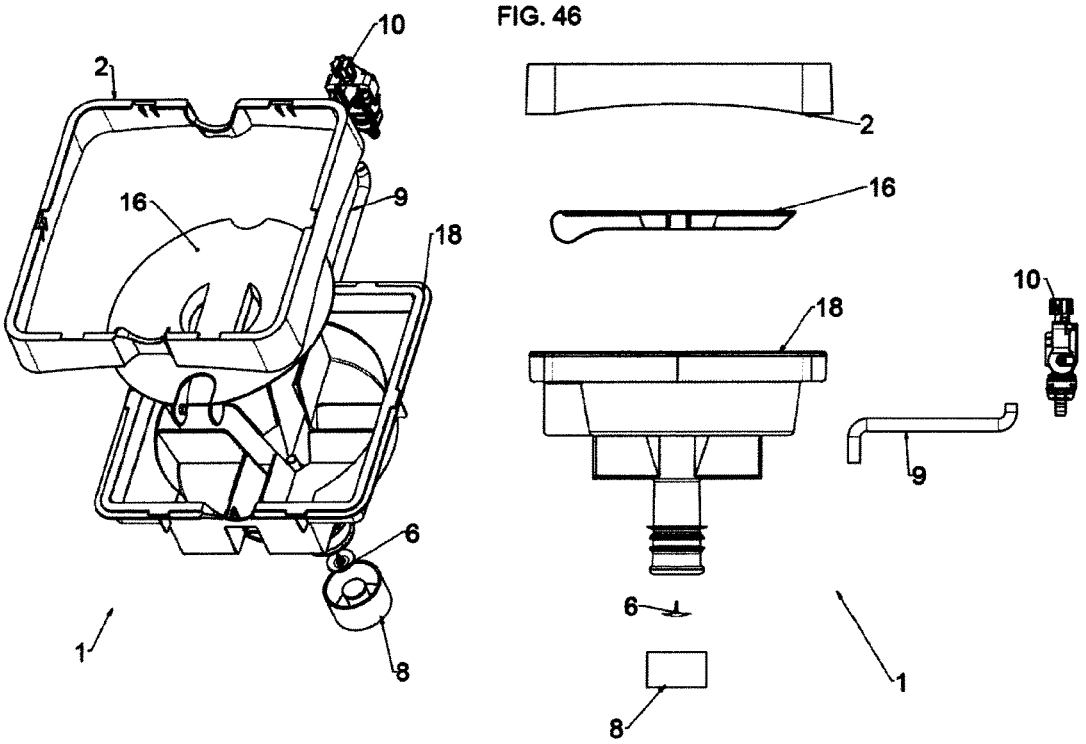
FIG. 46 is an exploded view of the kit of FIG. 43.
Figure 47:
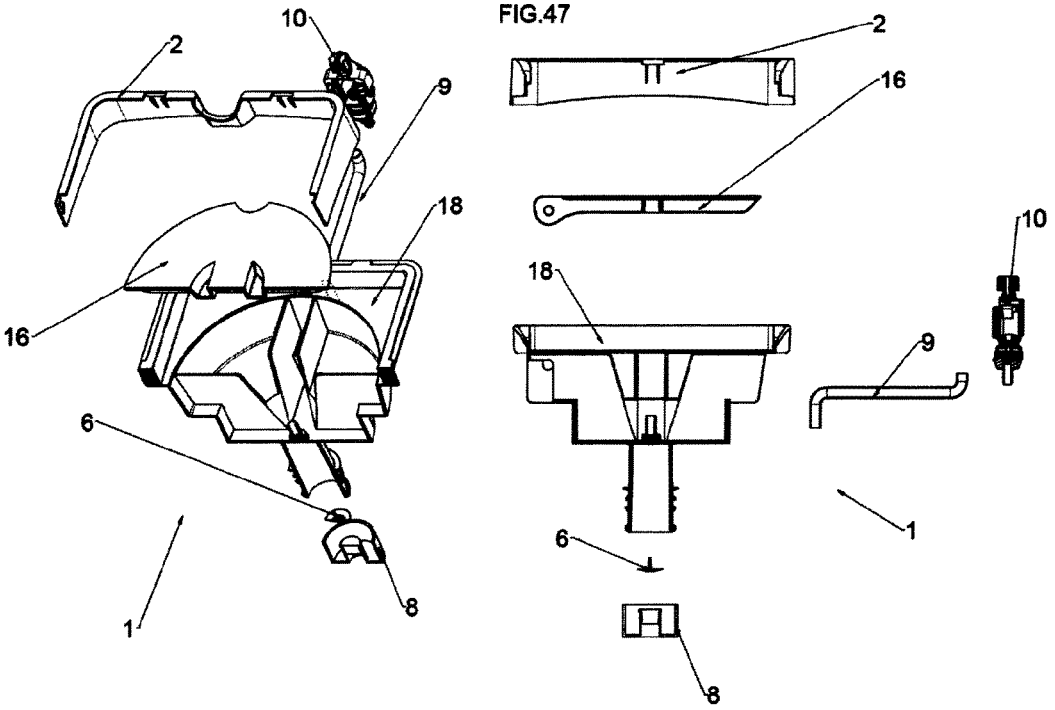
FIG. 47 is an exploded sectional view of the kit of FIG. 43.
Figure 48:
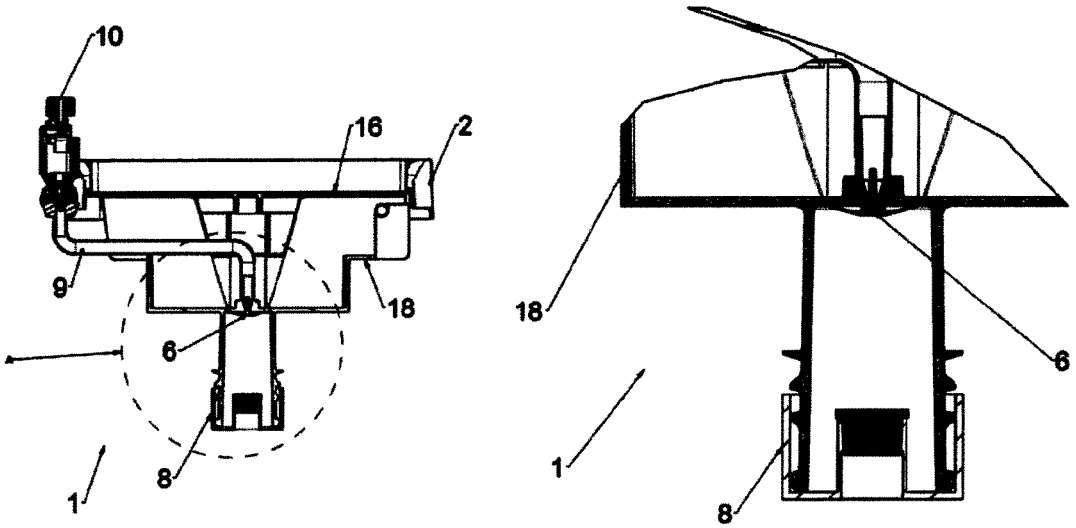
FIG. 48 is a side sectional view of the kit of FIG. 43 and a detailed view of the connection system.
Figure 49:
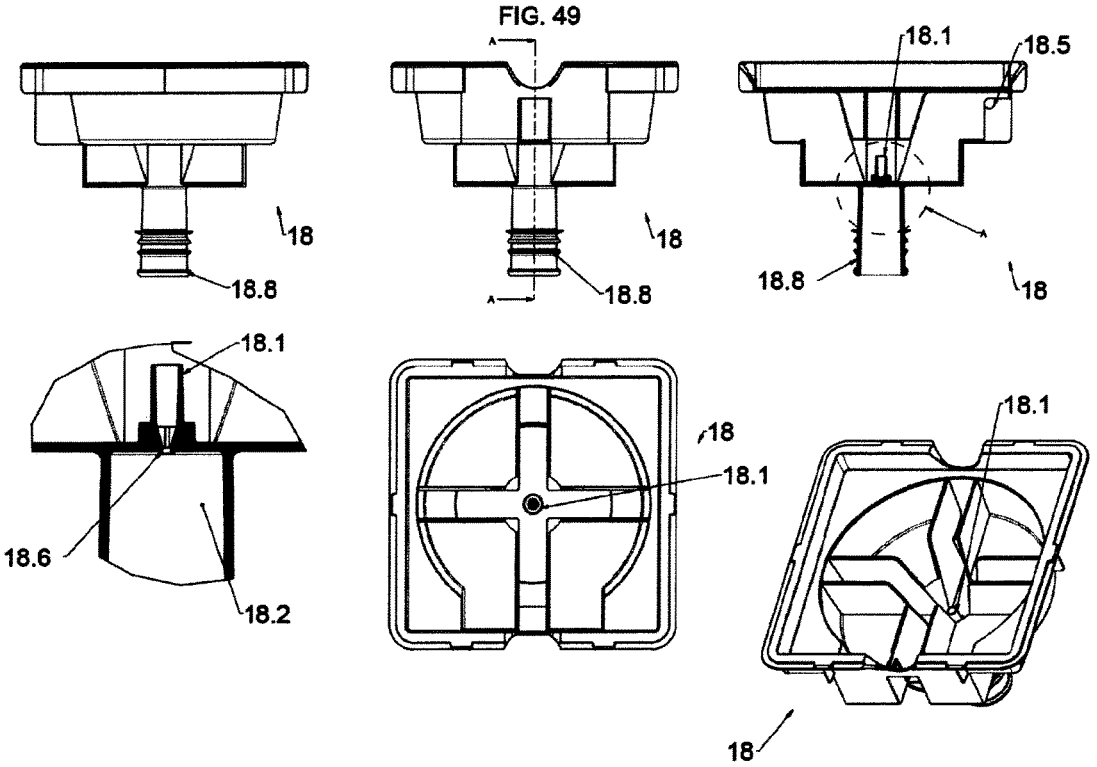
FIG. 49 is a perspective, side, front, upper and detailed view of the main body of kit Model 2 for Closed Systems with neck profile for seat plug of the "valve lock" Bericap type.
Figure 50:
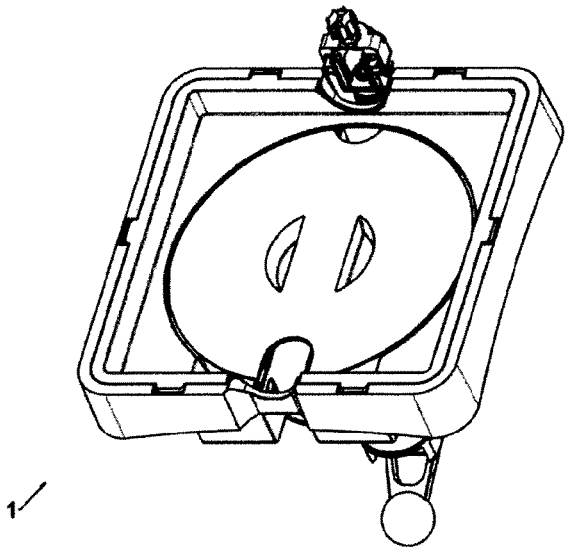
FIG. 50 is the perspective view of kit Model 2 with the lower part of the body shaped as a carafe neck for water crocks and with plug of the "valve lock" Bericap type and inserted floating module for Open Systems.
Figure 51:
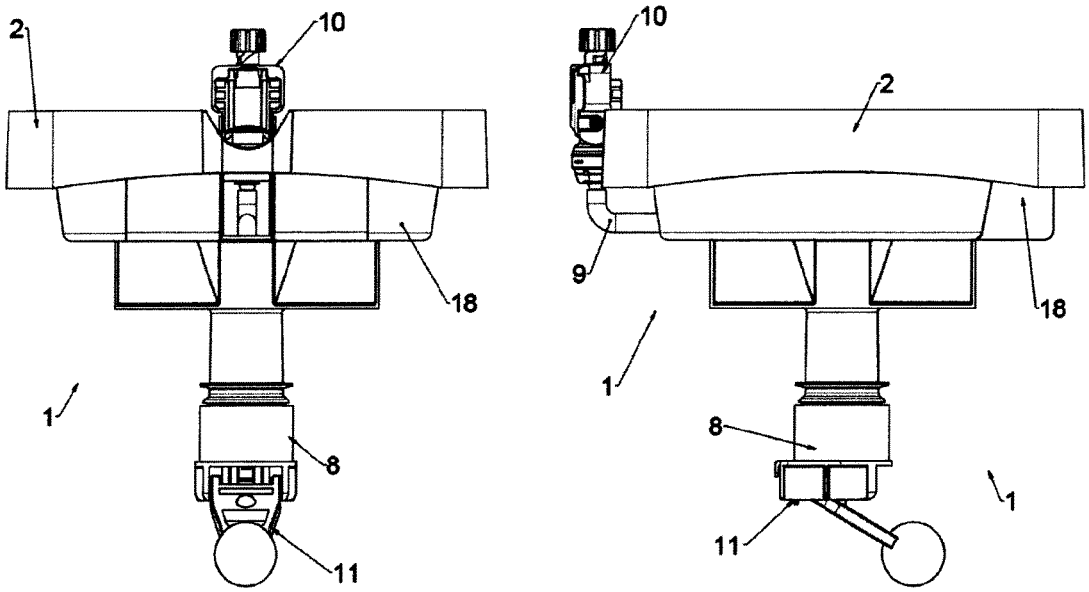
FIG. 51 is a side and front view of kit Model 2 for Open Systems having inserted the optional floating system.
Figure 52:
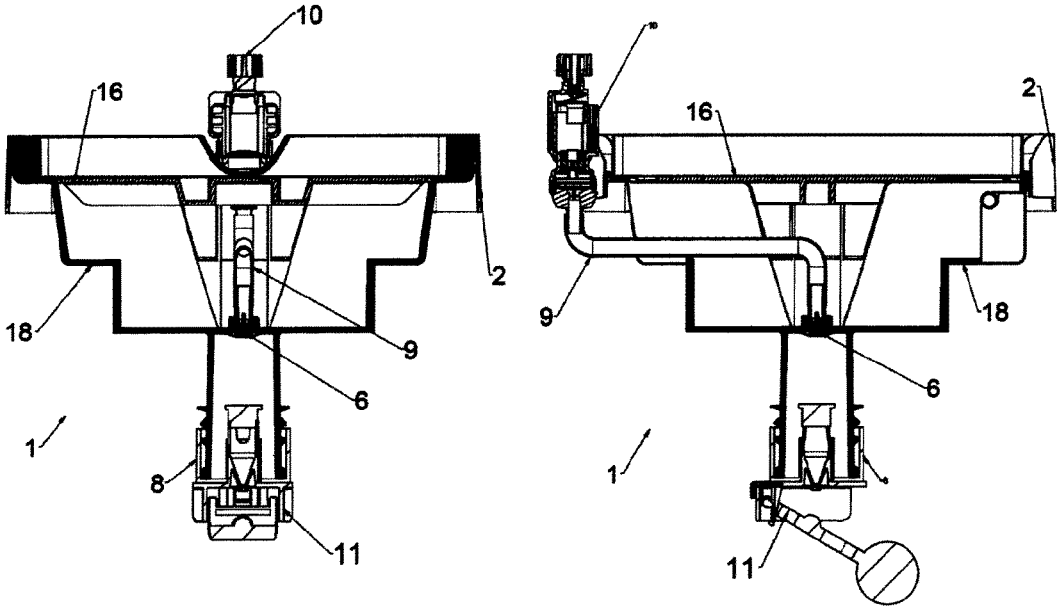
FIG. 52 is a sectional view of the kit of FIG. 51.
Figure 53:
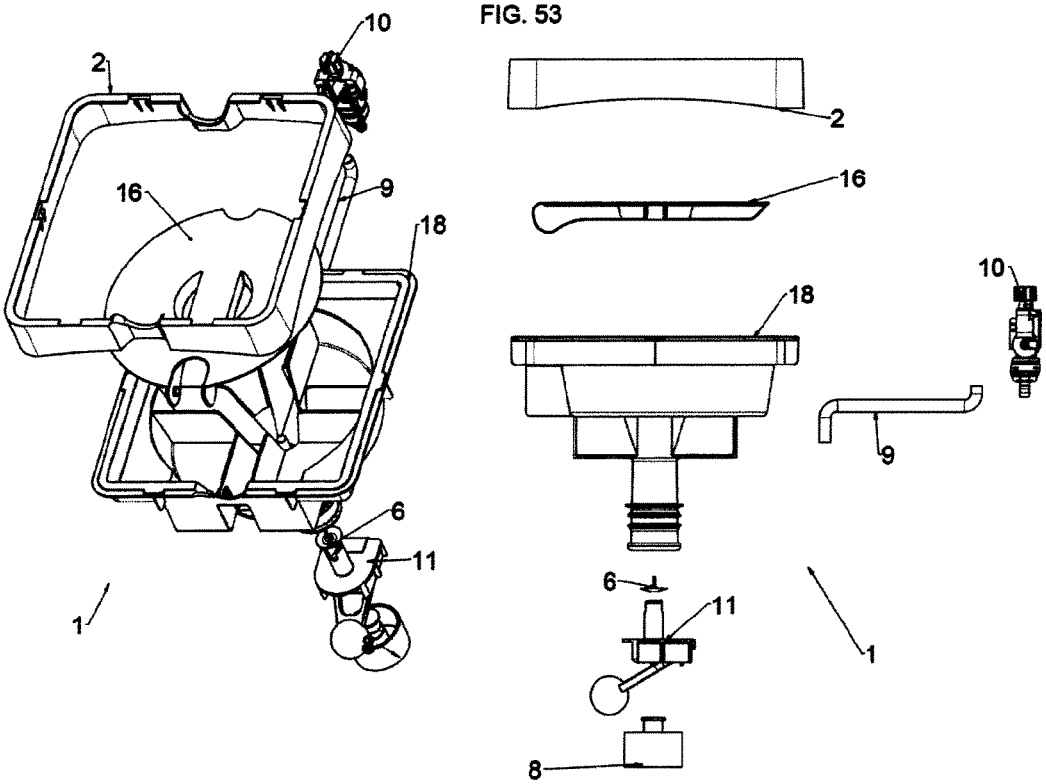
FIG. 53 is an exploded view of the kit of FIG. 51.
Figure 54:
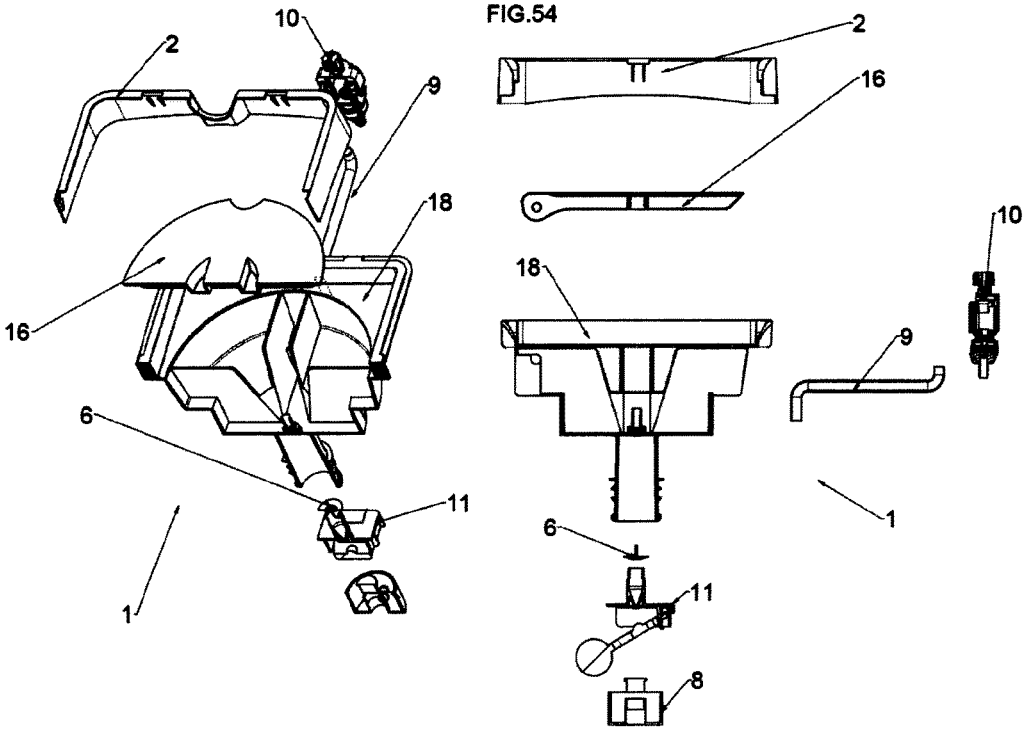
FIG. 54 is an exploded sectional view of the kit of FIG. 51.
Figure 55:
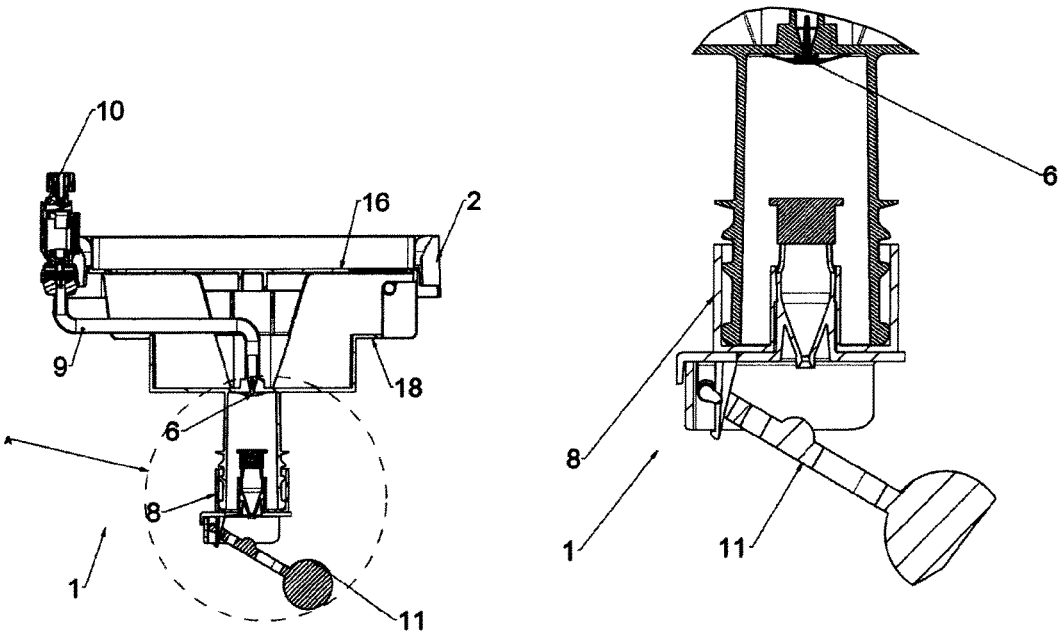
FIG. 55 is a side sectional view of the kit of FIG. 51 with floating system inserted in the kit plug and a detailed view of the optional floating system.

As regards the version of this kit for Closed Systems, with reference to FIG. 45, it can be noted that, in the lower part of kit Model 2, a geometry has been obtained which is useful for the connection of the plug 8, which will allow inserting the kit 2 in Closed Systems equipped with PIN 13 with safety valve (FIG. 56).

The obtained geometry is wholly copied (as occurred for Model 1) from the neck of commercial water crocks.

The floating valve 11, like in Model 1, could be adapted thereto, and is useful to connect Model 2 with carafe profile and plug 8 directly to an Open System, as alternative to the first type of kit Model 2 described above and shown in FIGS. 33 to 41.

This Model of kit has the great advantage of making the kit 1 flexible, which will allow the end user to have in a single kit 1 the chance (inserting or not the floating module 11) of being connected to Open Systems (FIG. 57) and Closed Systems (FIG. 56). The disadvantage which can be noted in connecting kit Model 2 with the version with water crock neck+plug 8+floating module 11 on an open system is that the system remains open, while with the kit Model 2 shown in FIG. 34 for Open Systems with sealing OR-ring 15, will transform the Open System into a Closed System, which is much more hygienic, since it is not subjected to possible external contaminations.

The invention claimed is:

1. A delivering device of liquids contained in water crocks, said delivering device being equipped with an assembly for replacing water crocks with bag-in-box (BIB) vessels for delivery, said assembly being adapted to perform a placement and a connection of the BIB vessels on the delivering device, the assembly comprising:

a main supporting and containing body;

at least one plate connected to said main supporting and containing body and adapted to place thereon at least one BIB vessel;

at least one connector connected to said main supporting and containing body through a flexible hose and adapted to be connected to a delivering tap of the at least one BIB vessel;

at least one plug connected to said main supporting and containing body and adapted to be connected to a pin of said delivering device;

at least one connecting tube placed in said main supporting and containing body and connected to said flexible hose for communicating said at least one BIB vessel with said delivering device; and at least one check valve assembly placed in said main supporting and containing body and adapted to be connected to and be contained in said at least one plug to prevent liquid from re-entering into said main supporting and containing body, wherein the delivering device is further equipped with at least an inspection plate constrained to the main supporting and containing body through a hinge, adapted for inspecting a connection between the at least one connector and the main supporting and containing body.

2. The delivering device of claim 1, wherein the main supporting and containing body is equipped with a lower part shaped as water crock neck useful to receive and operate with the at least one plug.

3. The delivering device of claim 1, wherein the main supporting and containing body is equipped with a lower geometry with shape useful for positioning a sealing ring adapted to directly operate on the delivering device.

4. The delivering device of claim 1, wherein the connecting tube is placed in a lateral position with respect to an axis of the main supporting and containing body.

5. The delivering device of claim 1, wherein the connecting tube is placed in an axial-central position with respect to an axis of the main supporting and containing body.

6. The delivering device of claim 1, wherein the plug is of a valve lock type.

7. The delivering device of claim 6, wherein the plug is of a Bericap® type.

8. The delivering device of claim 1, wherein the at least one plate is further equipped with a cover for supporting said at least one BIB vessel.

9. The delivering device of claim 1, wherein the at least one plate is further equipped with a calibrated spring in order to make a balance mechanism for measuring and signaling an amount of water remaining in the least one BIB vessel.

10. The delivering device of claim 9, wherein the at least one plate is operatively connected to the main supporting and containing body by means of a flexible tooth obtained on a central cylinder with recessed geometries and anchored to the main supporting and containing body by means of small tooth geometries obtained on extreme part of the central cylinder, adapted to block the at least one plate when a spring, which is in a seat obtained in the main supporting and containing body and a seat obtained on the at least one plate, reaches a pre-fixed position, said at least one plate being further vertically guided by hole geometries obtained on the at least one plate and cooperating with conical supporting elements obtained on the main supporting and containing body, said at least one plate being further equipped with external guide geometries adapted to cooperate with rib geometries present on the main supporting and containing body.

11. The delivering device of claim 9, wherein the main supporting and containing body comprises:

first walls adapted to contain and guide the at least one BIB vessel placed above the assembly;

a second wall equipped with a stiffening edge, which follows a wall profile for stiffening and for creating a seat for an interchangeable cover;

a plane adapted to replace the balance mechanism of the at least one plate and the calibrated spring, said plane cooperating with conical supporting elements and ribs making a rigid supporting area for the at least one BIB vessel;

contrasted openings adapted to place a delivery tap on one side or the delivering tap on the at least one connector on another side; and a guided seat of the calibrated spring with walls guiding and containing the calibrated spring.

12. The delivering device of claim 9, wherein the balance mechanism comprises a graduated scale obtained on an external box of the at least one BIB vessel so that the calibrated spring lifts the at least one plate as a weight of the at least one BIB vessel decreases causing the graduated scale to indicate an approach to a limit for needing a change of the at least one BIB vessel.

13. The delivering device of claim 9, wherein the balance mechanism comprises an electronic system with load cell or various types of sensors connected to a weight of the at least one BIB vessel.

14. The delivering device of claim 1, wherein the at least one check valve assembly is composed of an umbrella-type check valve and of a valve-carrier body separated from the main supporting and containing body.

15. The delivering device of claim 14, wherein a small connecting tube is in an axial-vertical position on the main supporting and containing body, a valve-carrier geometry being present directly on the main supporting and containing body, while, below the small connecting tube, necessary geometries are obtained for fastening an umbrella valve, below the umbrella valve being a cylinder shape so that the liquid always has a passage area and the umbrella valve is free of correctly working, said cylinder shape protecting the umbrella valve from members inside a tank of a water dispenser, the cylinder shape having a predetermined height for making a sealing ring seal in the tank of the water dispenser without impact from the members inside the water dispenser, said main supporting and containing body being further equipped with geometries adapted to block and contain the sealing ring and with a recess obtained on a lowest part of the main supporting and containing body which is used for having an area to be able to remove the sealing ring.

16. The delivering device of claim 1, wherein the at least one check valve assembly is composed of a check valve and a valve-carrier body directly obtained on the main supporting and containing body.

17. The delivering device of claim 1, further equipped with at least one gasket adapted for a liquid seal between the main supporting and containing body and a tank for containing the liquids of the delivering device.

18. The delivering device of claim 1, further equipped with a floating valve module placed between the at least one plug and a tank for containing the liquids of the delivering device.

19. The delivering device of claim 18, wherein the floating valve module is composed of:

a main connecting body, a floating arm, and blocking means of a hinge on which the floating arm rotates, on the floating arm being obtained a sealing valve and a floater, a sealing area of the floating arm making an operative seal when the floating arm is in a closing position with one of a cone and a cylinder, an interior of the main connecting body in the sealing area being shaped in order to have a Venturi effect, and since a high pressure arrives from the at least one BIB vessel above the assembly to the floating valve module, the floating valve module being placed on the assembly by insertion in an operating seal with the at least one plug by means of a calibrated cylindrical wall.

20. The delivering device of claim 1, wherein the inspection plate is equipped with rib-type stiffening geometries which are also used as guide for the inspection plate when closing and opening, cooperating with internal ribs of the main supporting and containing body, said inspection plate having hinge-type fastening elements that operatively engage geometries created on the internal ribs, or holes, of the main supporting and containing body, said inspection plate being further equipped with a recessed element which allows having a catch area when the inspection plate must be opened once constrained to the main supporting and containing body.

* * * * *